United States Patent [19]

Bowler et al.

[11] 4,130,095

[45] Dec. 19, 1978

[54] FUEL CONTROL SYSTEM WITH CALIBRATION LEARNING CAPABILITY FOR MOTOR VEHICLE INTERNAL COMBUSTION ENGINE

[75] Inventors: Lauren L. Bowler, Bloomfield Hills; John E. Lahiff, Farmington, both of Mich.

[73] Assignee: General Motors Corporation, Detroit, Mich.

[21] Appl. No.: 856,238

[22] Filed: Dec. 1, 1977

Related U.S. Application Data

[63] Continuation-in-part of Ser. No. 814,884, Jul. 12, 1977, abandoned.

[51] Int. Cl.[2] ..... F02G 3/00; F02M 7/00

[52] U.S. Cl. ..... 123/32 EE; 123/119 EC; 123/32 EB; 60/276; 60/285

[58] Field of Search ..... 123/32 EB, 32 EC, 32 EE, 123/32 EA, 119 EC; 60/276, 285

[56] References Cited

U.S. PATENT DOCUMENTS

| | | | |
|---|---|---|---|
| 3,906,207 | 9/1975 | Rivere | 123/32 EB |
| 4,009,699 | 3/1977 | Hetzler | 123/32 EB |
| 4,046,118 | 9/1977 | Aono | 123/119 EC |

*Primary Examiner*—Ronald B. Cox

*Attorney, Agent, or Firm*—Howard N. Conkey

[57] ABSTRACT

A memory type fuel control system and method of operating a motor vehicle internal combustion engine having a three-way catalytic converter. A fuel flow control system provides a fuel supply rate near the air/fuel ratio at which the catalytic converter has maximum three-way conversion efficiency. The fuel supply rate so determined is trimmed by a trim factor recalled from memory, the authority of this trim factor being sufficient to compensate for engine and controller variations with time, manufacturing tolerances, etc. In the preferred form, the trim factor is stored in memory at an address determined by the same engine operating conditions that control the fuel supply. The engine exhaust gas oxidizing/reducing conditions are sensed by exhaust gas sensors. In the preferred form, a closed loop controller is responsive to the deviation of the sensed oxidizing/reducing conditions from the condition at which the catalytic converter has maximum three-way conversion efficiency to adjust the trimmed fuel supply rate in a sense to produce the oxidizing/reducing condition at which the maximum conversion efficiency is obtained. A sampling circuit recurrently samples and momentarily stores the engine operating conditions, such as engine load and speed conditions, in a short term memory to form a history of those conditions extending back at least by the amount of the engine transport delay time. At a later time, the exhaust gas oxidizing/reducing conditions sensed by the exhaust gas sensor is sampled, the engine operating conditions that produced the sampled exhaust gas condition are recalled from the short term memory, a new trimming value is determined for the recalled vehicle conditions which more closely produce a desired oxidizing/reducing condition, and such value is inserted in the main memory at the address determined by the recalled conditions. Such trim factor is then available for recall and use as the trimming factor when the engine is next operated under such conditions.

14 Claims, 19 Drawing Figures

FUEL CONTROL SYSTEM WITH CALIBRATION LEARNING CAPABILITY FOR MOTOR VEHICLE INTERNAL COMBUSTION ENGINE

This invention is a Continuation-In-Part of application Ser. No. 814,884, now abandoned filed on July 12, 1977.

The type and amount of combustion products present in an internal combustion engine exhaust are determined in large part by the ratio of air to fuel in the mixture supplied to the engine. Mixtures with excess fuel tend to produce higher amounts of hydrocarbons and carbon monoxide; whereas mixtures near stoichiometric, but having excess air, tend to produce greater amounts of oxides of nitrogen. One way simultaneously to change the hydrocarbon and carbon monoxide constituent of exhaust gases to water and carbon dioxide, and the nitrogen oxide constituents to molecular nitrogen and oxygen is by the use of catalytic converter action. With a properly designed catalytic converter, both the oxidation of CO and HC and reduction of $NO_x$ can be achieved, provided that the air/fuel mixture supplied to the catalytic converter is maintained within a narrow band near stoichiometry (the mixture wherein the oxygen required to oxidize the HC and CO is substantially the amount that needs to be removed to reduce the $NO_x$). Within the range of present significance, when the air/fuel ratio goes in the excess of fuel direction, the converter tends to be more efficient in reducing $NO_x$, but its ability to oxidize carbon monoxide and hydrocarbons is reduced. If the air/fuel ratio goes in the excess air direction within the presently significant range, the converter is more effective in oxidizing HC and CO, but becomes less effective in reducing $NO_x$. The most effective conversion of nitrogen oxides, carbon monoxides, and hydrocarbons to carbon dioxide, water, and molecular nitrogen occurs at an air/fuel ratio within a narrow range near stoichiometry.

In prior art open loop fuel control, the fuel delivery mechanism (e.g., carburetor, pressure carburetor, fuel injection system, etc.) has a fuel delivery rate responsive to controlling engine operating parameters, such as engine load and speed or mass air flow, so as to provide an air/fuel ratio which is generally at a desired ratio. In motor vehicles, the required fuel delivery rate must be achieved for the wide range of speed, engine load, temperature and other operating parameters normally encountered. This needs to be done despite changes in the engine components with time, fuel variations, etc., that occur after the motor vehicle is placed in use and are difficult or impossible to take into account in open loop systems.

This difficulty of open loop operation has prompted proposals to use various forms of closed loop fuel control systems. In the most common closed loop system, the air/fuel ratio of the mixture supplied to the internal combustion engine is controlled by a sensor responsive to a gas constituent indicative of the sense and degree the converter action deviates from the desired action. Elemental oxygen is commonly sensed. These systems commonly employ a zirconia oxygen sensor, which provides an output signal which shifts rather abruptly between two voltage levels with small changes in the air/fuel ratio around stoichiometry. One voltage level occurs when relatively oxidizing conditions exist and the other voltage level occurs when relatively reducing conditions are present.

Closed loop fuel control systems can provide relatively accurate fuel-air control under constant or slowly varying vehicle operating conditions. However, under varying conditions, they cannot accurately respond because of the transport time delays inherent in the engine-vehicle system. If the engine (and vehicle) is operating under conditions wherein the fuel metering is not exactly correct, a time period (e.g., one second) elapses between the existence of the incorrect fuel supply at the engine intake and the response of the sensor in the exhaust system that calls for a correction. By this time, however, the engine (particularly in motor vehicle usage) may be operating under different conditions where a different correction, or perhaps an opposite or no correction at all, is needed. Consequently, during transient engine operating conditions, the fuel supply correction is in effect chasing a moving target and may call for changes other than the correct ones. When the air/fuel ratio is changed to compensate for past lean operation after the operation has returned toward normal, engine output carbon monoxides and hydrocarbons tend to rise. Conversely, when the air/fuel ratio is changed to compensate for past rich operation after the operation has returned toward normal, nitrogen oxides tend to increase. This form of error primarily results from the engine system transport delay between the introduction of fuel into the engine intake system and the time the oxygen (or other) sensor can sense the resultant conditions in the catalytic converter. Additionally, when the open loop calibration of the fuel supply system is such that sudden variations in the air/fuel ratio may result when the engine operating conditions change, the closed loop gain must be such that a generally rapid correction to the desired ratio is provided. However, this results in an increase in the peak-to-peak limit cycle excursions in the air/fuel ratio resulting from the integral term in the closed loop control in conjunction with the engine transport delay time.

Components of the transport delay include the time required for the change in the mixture of air and fuel to appear at the engine cylinder intake ports, the time for the cylinders to perform intake, compression, power and exhaust strokes, the time for the exhaust pipe gas to respond to the change in the exhaust gas discharge from the cylinders, and the time for the exhaust gas to travel to the exhaust gas sensor. In addition to this transport delay, there are other delays in the system that decrease the extent practical closed loop systems can provide immediate response to varying engine operating conditions.

Whether a system is solely open loop, or includes closed loop components, these systems of the prior art do, within limits, respond to variations in the engine operating conditions. For example, if the open loop fuel control is of the speed density type, the fuel input is determined from the instantaneous engine speed and the instantaneous manifold absolute pressure. The system thus responds in open loop fashion to these changes on a substantially instantaneous basis. While the closed loop does not provide this rapid response, it can usually contribute to the proper fuel metering. These control systems do not, however, take into account in any significant way the fact that corrections in fuel metering are determinable only after the engine transport delay.

It is a general object of the present invention to provide an improved fuel control system that effectively takes into account the engine transport delay, even though the engine operating conditions are rapidly continuously varying.

It is a more particular object of the present invention to provide an improved method of and means for controlling the fuel supply to a motor vehicle internal combustion engine and for operating the same wherein a fuel control system is provided with a trimming value that modifies the rate of fuel supply otherwise provided by the system, the trimming value being recalled from memory to modify the fuel rate otherwise provided, and the memorized trimming values being updated from time to time as engine operations take place, taking into account the engine transport delay.

Another object of the present invention is to provide an improved method and means of the foregoing type wherein, during engine and vehicle operation, a recurrent determination is made of the proper trimming value for the conditions of engine speed, and load (and other parameters, if desired) actually encountered in engine and vehicle operation and upon each such recurrent determination (or, if desired, an averaged group of them) the new proper trimming value is entered in the memory in lieu of the previously recorded value to be recalled when the engine again operates under such conditions.

Still another object of the present invention is to provide an improved method and means as above described wherein the repetition rate of the recurrent determinations of the updated trimming value is such that in normal practical vehicle operation, the memory is effectively updated to provide open loop fuel control operation that closely approaches the optimum.

It is yet another object of the present invention to provide an improved method of and means for controlling the fuel supply to a motor vehicle internal combustion engine and for operating the same wherein two levels of memory, one short and the other long, advantageously cooperate to achieve open loop fuel control under dynamic conditions with accuracy approaching that of closed loop fuel control under steady state conditions.

Still another object of the present invention is to provide an improved method of and means for controlling the fuel supply to a motor vehicle internal combustion engine and for operating the same wherein two levels of memory are provided, one being a short term memory effective for at least the engine transport delay period for readjusting the relation of fuel rate to engine operating parameters and the other being a longer term substantially permanent memory containing at least the most recently updated fuel control values, for operation of an open loop fuel control.

Further, it is an object of the present invention to provide an improved system and method of operation of an internal combustion engine and motor vehicle wherein engine operating parameters are recurrently sampled and stored for a short time to form a history of engine operation extending over the range of engine transport delay time, exhaust gas conditions are recurrently sensed, the stored engine operating parameters that caused the sensed exhaust gas condition are recalled, the extent the fuel supply should be altered from the actual earlier value is determined and stored at the proper address in a main memory, and such value is recalled from memory and used when the engine and vehicle next operate at the conditions of the original sampling.

Another object of this invention is to provide an improved system and method of the foregoing type wherein the stored engine operating parameters are recalled after the engine transport delay time determined primarily by the value of engine speed.

Another object of the present invention is to provide an improved system and method of operation of an internal combustion engine and motor vehicle wherein successive determinations are made of the fuel-controlling operating conditions of the engine and the fuel rate at a recurrent rate that is rapid in relation to the engine transport delay, the successive values are recorded at time-addressed locations in a short term memory bank, the exhaust conditions are likewise successively sensed, the fuel-controlling operating conditions of the engine and the fuel rate that apply to the respective sensed exhaust condition determinations are successively recalled from the short term memory bank, a proper new fuel rate is determined for each such recalled event, and a value providing such proper new fuel rate is recorded on the main memory at the address determined by such fuel-controlling operating conditions of the engine in lieu of the previously stored value.

Still another object of the present invention is to provide an improved system and method of operation of an internal combustion engine and motor vehicle wherein the foregoing determinations are substantially continuously made, and the corrective value recorded on the main memory at each memory location is updated in accordance with the actual vehicle operating experience, and wherein the rate of such updating is such as to provide a close approximation to the optimum engine operating conditions at all times.

Another object of this invention is to provide an improved system and means for operation of an internal combustion engine and motor vehicle that achieves some or all of the foregoing objects and that is cooperatively associated with a closed loop controller directly responsive to the exhaust gas condition to obtain a predetermined exhaust gas condition to a degree not generally achievable by each one individually.

It is another object of this invention to provide apparatus and methods for accomplishing the foregoing objects which may be used in any fuel delivery system including mass flow, speed density or other types of fuel determination and with carburetor, pressure carburetor, intake port injection, cylinder injection or other methods of introducing the fuel into the engine air.

It is a more specific object of the present invention to provide apparatus and specific methods for accomplishing the foregoing objects which are simple, practical, reliable, relatively inexpensive, readily manufactured and serviced, and in other respects are suitable for usage on motor vehicles owned and operated by the general public.

The preferred embodiment hereinafter set forth and described in detail relates to a fuel control system and method of operating a motor vehicle internal combustion engine wherein a catalytic converter operates in three-way action in the engine exhaust passage for converting exhaust gas constituents in accordance with the oxidizing/reducing conditions in the exhaust passage. An open loop fuel flow control signal is generated in response to engine loading and speed (and other parameters, if desired) having a value determined to provide a fuel supply rate and air/fuel ratio generally at or close to the rate and ratio at which the catalytic converter has a desired three-way conversion efficiency. This open loop fuel flow control signal includes a trimming component recalled from a main memory at a location addressable in accordance with the engine load and speed conditions (and other parameters, if desired). An exhaust gas sensor responds to the oxidizing/reducing conditions in the exhaust passage (and hence to the degree the desired oxidizing/reducing conditions are achieved) to provide a signal determined by such oxidizing/reducing conditions and the sensor characteristics. This response is delayed in time from the causative fuel input by the engine transport delay, which in turn depends in part on engine operating conditions. A closed loop adjustment of the open loop fuel control signal is provided in response to the sensed exhaust gas conditions to provide a system fuel supply rate and air/fuel ratio that more closely approaches the rate and ratio at which the catalytic converter has the desired three-way conversion efficiency.

In the method and system herein described, at least the engine load and speed conditions are recurrently sampled. Preferably, a value representing the then-applied trimming factor is also sampled. In the preferred method and system, this occurs at intervals substantially less than the transport delay time (e.g., sampling at 40 millisecond intervals in a preferred form) so that substantially all of the engine operating points are sampled during an engine transient condition. A plurality of these sampled values are stored at time-related addresses in a short term memory bank to form a history of engine operation that at least spans the possible engine transport delay times. Thus, if the engine transport delay time may vary from 0.3 second to 1.5 seconds, the history at any time covers the 0.3 to 1.5 seconds prior time (and in a preferred form covers all prior times up to 1.5 seconds). At successive times, preferably at the same time intervals as the samples are taken, the sensed exhaust gas condition is sampled, the engine conditions (e.g., speed and load) required to compute transport delay are sampled and the engine transport time computed. The computed transport time identifies the address in the short term memory bank from which the prior engine load and speed conditions that generated the sensed exhaust condition are recalled. The prior trimming factor is then determined by recalling the previously stored value at the same address (or by recalling from the main memory at the address determined by engine speed and load) and other address values (if any) provided by the short term memory. This recalled information is then used in conjunction with the sensed exhaust conditions to compute a new trimming value adjusted to provide the correction required (if any). This new trimming value is then inserted in the main memory at the address determined by the recalled load and speed conditions (and other conditions, if desired). This updated trimming factor is then available for recall and engine control when the engine is next operated under such load and speed conditions. The updating of the trimming factor (calibration learning) is coordinated with the closed loop adjustment so that neither interferes with the action of the other. However, as will be described, they cooperate to provide effective operation wherein each contributes to achieving the desired air/fuel ratio to obtain the desired oxidizing/reducing conditions in the exhaust gases to a degree not generally achievable by each one separately.

The novel aspects considered to be characteristic of the present invention are set forth with particularity in the appended claims. The invention itself, both as to the steps of the process and the structure of the apparatus, together with further objects and advantages thereof, will be evident from the following description taken in conjunction with the accompanying drawings, in which:

Figure 3:
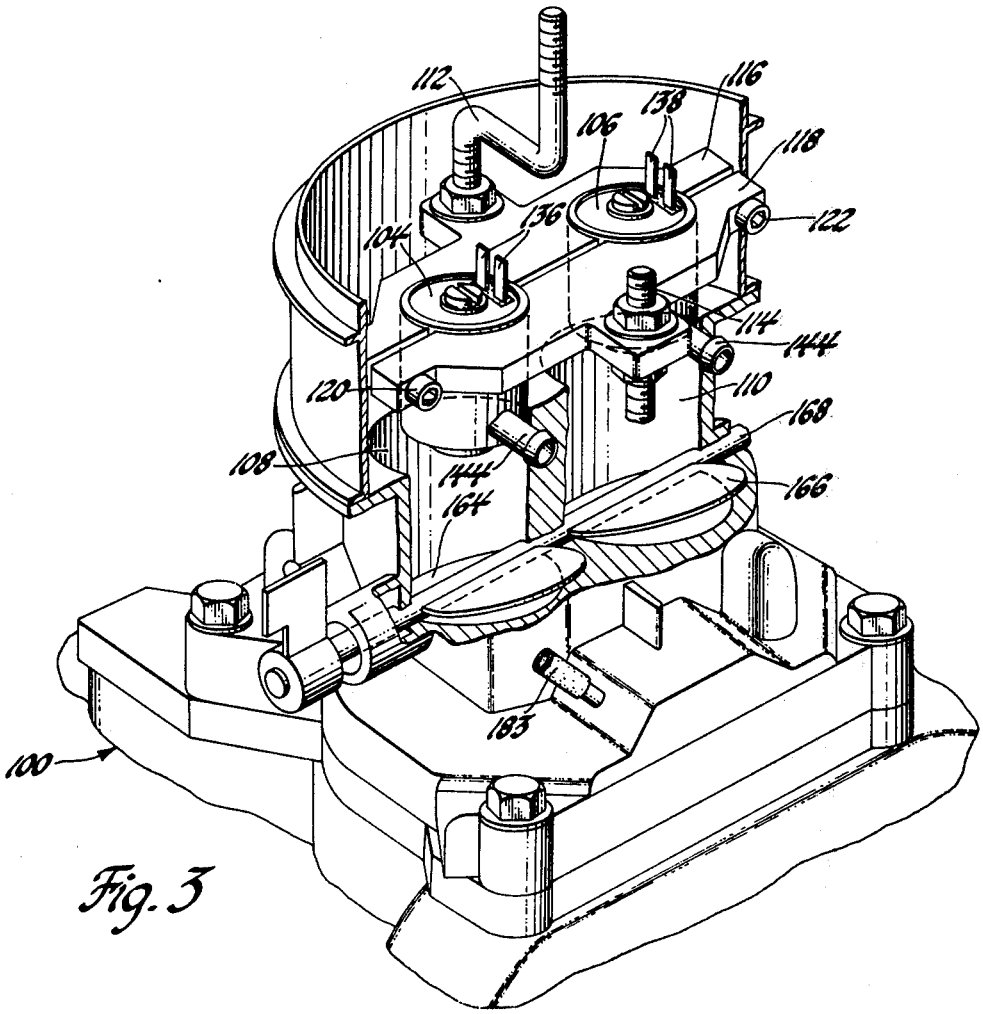
FIG. 3 is an enlarged view in perspective with parts broken away of the injectors and throttle assembly of the fuel delivery system of FIG. 1.

The fuel control system of this invention functions to control the air/fuel mixture supplied to an internal combustion engine 100 of an automobile 102. While the invention is applicable to any air/fuel delivery apparatus including, for example, a carburetor, the preferred embodiment of the invention employs a pair of solenoid operated fuel injectors 104 and 106 which, as best seen in FIG. 3, are mounted directly over a pair of throttle bores 108 and 110 leading into the intake manifold of the engine 102. The injectors 104 and 106 are positioned over the throttle bores 108 and 110 by a pair of threaded mounting posts 112 and 114 which carry a pair of clamping elements 116 and 118. The injectors 104 and 106 are held between the clamping elements 116 and 118 by a clamping force exerted by threaded elements 120 and 122.

Fuel is supplied to the fuel injectors 104 and 106 via a fuel supply line 123 by an electrically operated fuel pump 124 located in a fuel tank 126. The unused fuel flows from the injectors 104 and 106 and returns to the fuel tank 126 through a fuel return line 130. A pressure regulator 132 is located in the return line 130 and functions to maintain a nearly constant fuel pressure in the injectors 104 and 106. In the preferred embodiment, the pressure regulator 132 maintains the fuel pressure in the injectors 104 and 106 at a value of 10 psi. However, in another embodiment, the pressure regulator 132 maintains a constant fuel pressure of 39 psi.

Fuel under the regulated pressure is injected into the throttle bores 108 and 110 during the period that the respective fuel injectors 104 and 106 are energized by a voltage applied across the input terminal pairs 136 and 138.

Figure 1:
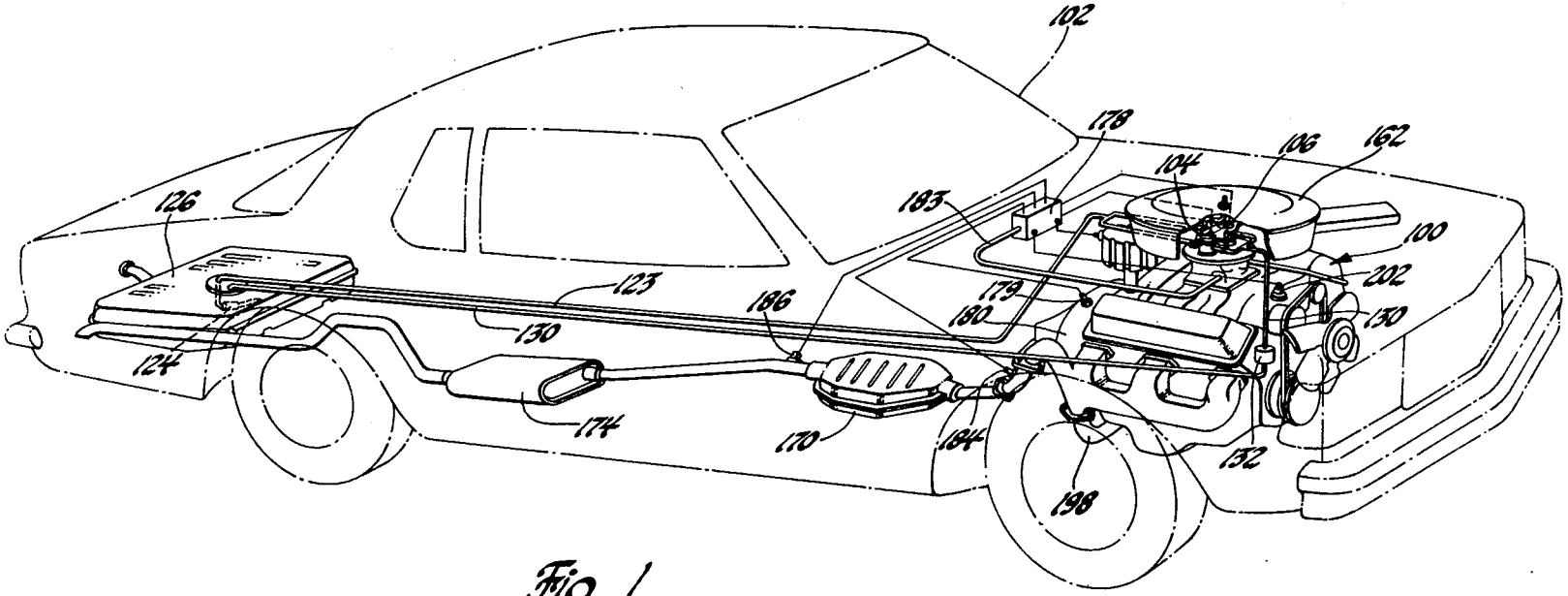
FIG. 1 is a perspective view in phantom of an automotive vehicle with the engine, fuel delivery system, exhaust system, the fuel supply controller and the sensors used to illustrate the present invention shown in solid lines.
Figure 2:
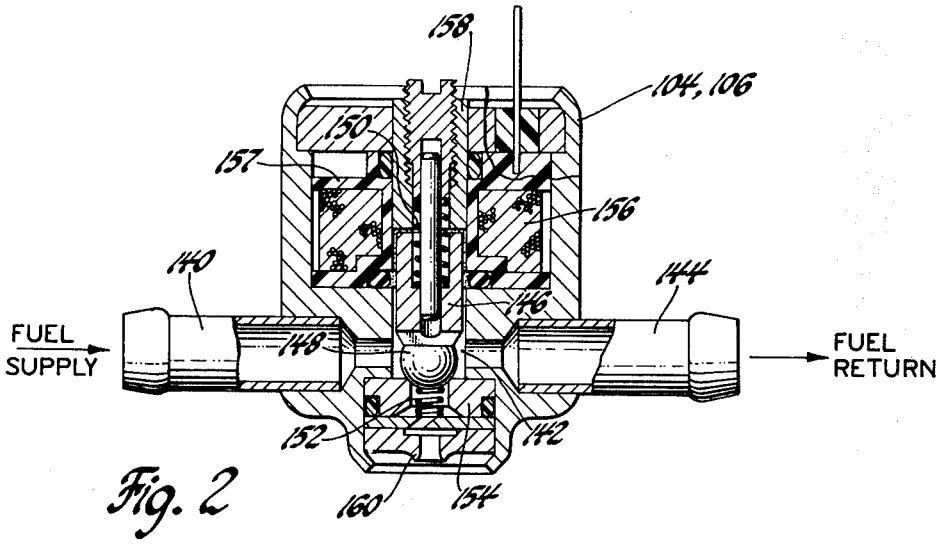
FIG. 2 is an enlarged axial sectional view with parts broken away of an illustrative injector of the fuel delivery system of FIG. 1.

The operation of the fuel injectors 104 and 106 to supply a measured amount of fuel to the throttle bores 108 and 110 may be best understood by reference to the axial sectional view with parts broken away of a fuel injector as illustrated in FIG. 2. Fuel under pressure from the fuel pump 124 is supplied through an inlet port 140 to an interior chamber 142. From the chamber 142, the fuel passes through the outlet port 144 diametrically opposed to the inlet port 140 and to the pressure regulator 132 of FIG. 1.

The fuel injector includes a movable core 146 which engages a flat portion of a semispherical valve 148. The end of the core 146 engaging the ball valve 148 is slotted to provide an additional fuel flow path between the inlet and outlet ports 140 and 144. The core 146 is biased by a compression spring 150 which moves the ball 148 against the force of a spring 152 into engagement with a valve seat 154. A winding 156 on a bobbin and terminal assembly 157 functions, when energized, to move the core 146 against the force of the spring 150 and into engagement with a pole piece 158. The ball valve 148 is moved with the core 146 by the spring 152 to open a passage for the pressurized fuel leading from the chamber 142 to a spray nozzle 160 from which fuel is sprayed into the throttle bore 108 or 110. When the winding 156 is deenergized, the ball valve 148 is again moved against the valve seat 154 to terminate the injection of fuel. By controlling the frequency and duration of energization of the coil 156, the amount of fuel metered into the throttle bore 108 or 110 may be controlled.

Referring again to FIG. 1, air is inducted into the intake manifold during operation of the engine 100 through an air cleaner assembly 162 and the throttle bores 108 and 110. The density of air in the intake manifold at a given engine speed is controlled by a pair of throttle blades 164 and 166, FIG. 3, located in the bores 108 and 110, respectively. The position of the throttle blades 164 and 166 is controlled by operation of a throttle shaft 168 whose rotation is controlled by the vehicle operator by means of conventional throttle linkages (not shown).

In general, the air inducted into the intake manifold and the fuel injected by the fuel injectors 104 and 106 form a combustible mixture drawn into the respective cylinders of the engine and burned, thereby producing heat which is converted to rotational energy for driving the automobile vehicle in the manner that is well known.

The combustion by-products flow into the exhaust manifolds and thence through a three-way catalytic converter 170. The exhaust gas output of the catalytic converter 170 then flows through a muffler 174 and is discharged into the atmosphere. The catalytic converter 170 is of the three-way type wherein carbon monoxide, hydrocarbons and nitrogen oxides are simultaneously converted if the air/fuel mixture supplied to the catalytic converter is maintained within a narrow band at stoichiometry, the ratio containing fuel and oxygen in such proportion that, in perfect combustion, both would be completely consumed. If the air/fuel ratio deviates from stoichiometry, the converter conversion efficiency of at least one of the undesirable exhaust constituents decreases. To provide for a desired conversion of the exhaust gas constituents, the fuel supplied by the injectors 104 and 106 must be of a sufficient quantity relative to the mass of air entering the manifold such that a predetermined air/fuel ratio is generally achieved.

While the invention is applicable to systems controlling the air/fuel ratio to values offset from stoichiometry to achieve improved conversion efficiency of one of the undesirable exhaust gas constituents, the invention will be illustrated in a system controlling the air/fuel ratio at stoichiometry to achieve maximum conversion efficiency of all three of the undesirable exhaust gas constituents. In this respect, a fuel controller 178 controls the energization of the injectors 104 and 106 so as to obtain a fuel flow providing a stoichiometric air/fuel ratio.

In the illustrative embodiment, the injectors are alternately energized by the fuel controller 178 with one of the injectors 104 or 106 being energized to deliver fuel once every intake event for a total of four injection pulses per engine revolution in an eight-cylinder engine. The injection event is timed by means of a signal output of the distributor 185, FIG. 7, which includes a position star wheel which functions to generate a pulse for each ignition event.

Figure 6:
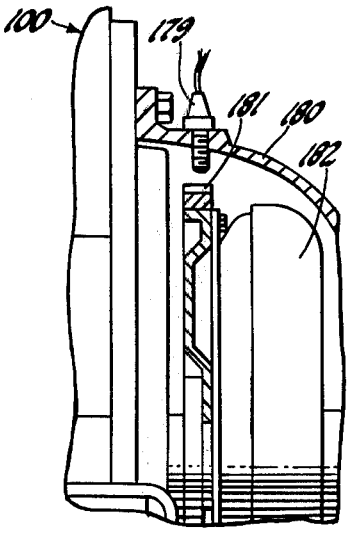
FIG. 6 is a view in axial section of the preferred embodiment of the engine speed sensing arrangement used in the present invention.

To determine the duration of injector energization required to achieve the amount of fuel to be injected with each injection event, the fuel controller 178 employs the speed density concept of fuel control. In this form of control, air flow into the engine 100 is determined from cylinder air density and engine speed. When the air flow is determined, the amount of fuel required to achieve stoichiometry can be determined. To determine air flow, the fuel controller 178 receives an engine speed input in the form of pulses having a frequency proportional to speed from a speed sensor 179 (best seen in FIG. 6) mounted in the bell housing 180 of the vehicle transmission and which senses the teeth on the ring gear 181 rotating with the vehicle flywheel 182. The manifold absolute pressure and hence cylinder air density is sensed by the fuel controller 178 by means of a tubing 183 which couples the manifold absolute pressure to a pressure sensor which may take the form of a silicon strain gauge, contained within the fuel controller 178. The fuel controller 178 is calibrated to respond in open loop fashion to the manifold absolute pressure and the engine speed to determine the duration of each injection event which would result in a fuel flow rate generally producing a stoichiometric air/fuel ratio at which maximum conversion efficiency of the catalytic converter 170 is obtained.

The actual mass of air entering a cylinder may vary from a value calculated from the manifold absolute pressure and engine speed as a function of the engine volumetric efficiency. For example, the mass of air entering the cylinder during each intake stroke is affected by such parameters as valve opening and closing times, EGR valve operation, and exhaust backpressure from the exhaust system. To compensate for these and other factors, the fuel controller 178 open loop calibration includes a volumetric efficiency term which results in a determined injection duration which generally produces a stoichiometric air/fuel ratio.

However, because of manufacturing tolerances resulting in engine-to-engine variations in, for example, valve opening and closing times, EGR operation, and exhaust backpressure, the volumetric efficiency varies from engine to engine. Further, the volumetric efficiency of an engine varies substantially between operating points and over the operational life of the engine. In view of these and other system variances and changes including sensor-to-sensor variations in fuel composition, it is difficult to provide for an open loop calibration which is responsive to the engine operating parameters to achieve an air/fuel ratio within the narrow range near-stoichiometry over the entire operating range of the vehicle engine and for its operating life. Consequently, an open loop fuel controller alone is generally incapable of achieving an air/fuel ratio at a desired constant near-stoichiometric value so that the desired conversion efficiency of the catalytic converter 170 of at least one exhaust gas constituent is not generally achieved.

The fuel controller 178 includes a closed loop control circuit which senses an exhaust gas constituent that is representative (after an engine transport delay time T) of the air/fuel ratio of the mixture supplied to the engine 100 and adjusts the duration of injector energization so as to more closely achieve the stoichiometric air/fuel ratio. In this respect, the preferred embodiment employs a first oxygen sensor 184, FIG. 7, mounted in the exhaust conduit upstream from the catalytic converter 170 and a second oxygen gas sensor 186 mounted in the exhaust conduit downstream from the catalytic converter 170. The authority of this closed loop system is generally limited and the primary fuel control provided is open loop. In the preferred embodiment hereinafter described, the closed loop system has a correction authority of about ± 25 percent and an integral term which varies the air/fuel ratio at a rate of approximately 0.9 air/fuel ratios per second.

The oxygen sensors 184 and 186 are preferably of the zirconia type which, when heated by engine exhaust gases to an operating temperature such as 700° F., generate an output voltage which changes abruptly as the air/fuel ratio of the exhaust gases passes through the stoichiometric level. Such sensors are well known in the art, a typical example being that shown in the U.S. Pat. No. 3,844,920 to Burgett et al, dated Oct. 29, 1974. The output voltages of the oxygen sensors 184 and 186 achieve their highest voltage levels with air/fuel ratios less than stoichiometry and their lowest voltage levels with air/fuel ratios greater than stoichiometry and exhibit a fairly steep slope as the air/fuel ratio passes through stoichiometry. The closed loop control circuit in the fuel controller 178 is responsive to the output signals from the oxygen sensors 184 and 186 to trim the flow rate of the fuel injectors 104 and 106 so as to more closely achieve a stoichiometric air/fuel ratio.

As previously indicated, the closed loop control circuit cannot accurately correct error in the open loop calibration of the fuel controller 178 during changing fuel requirements. One reason for the latter inability is the engine transport delay between the onset of a fuel requirement disturbing event and the time the resultant exhaust gas change is sensed by the oxygen sensors 184 and 186. We shall now describe this effect in more detail.

Figure 4:
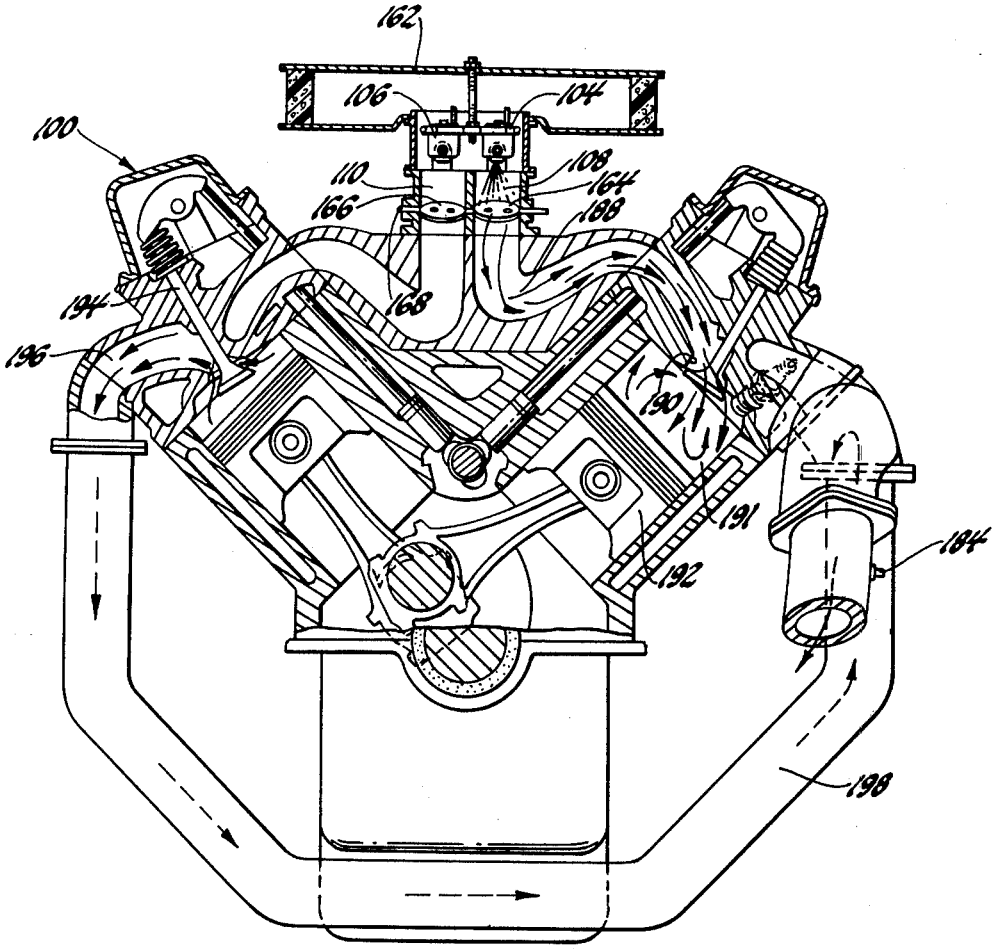
FIG. 4 is a section view transverse to the crankshaft axis of the engine of FIG. 1 with indicia illustrating the gas flow path during operation of the engine.
Figure 5:
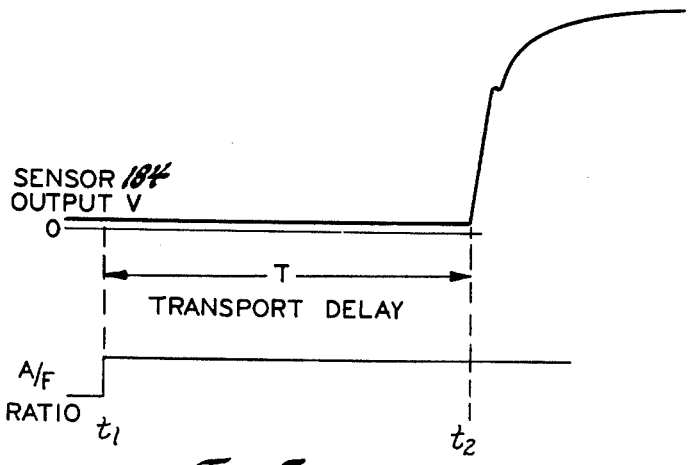
FIG. 5 is a diagram illustrating the delay in the response of an exhaust gas sensor to a change in the air/fuel ratio resulting from the engine transport delay.

The reasons for transport delay time T between a changed fuel requirement and sensing by the oxygen sensors 184 and 186 is illustrated in the sectional view of the engine set forth in FIG. 4 and the diagram of FIG. 5. The latter illustrates the response of the sensor 184 to a step change in the air/fuel ratio applied to the engine throttle bores 108 and 110 at time $t_1$ from a value greater than stoichiometry to a value less than stoichiometry. At time $t_1$, the output voltage of the sensor 184 is at its low level representing a lean air/fuel mixture. From the time that a specific air/fuel mixture enters the throttle bore 108 or 110 (the rich mixture introduced at time $t_1$ in the specific illustration), it travels into and through the intake manifold 188 to an intake valve passage 190. The mixture enters the engine cylinder 191 during the intake stroke of the piston 192, when the intake valve is opened. Thereafter, the piston undergoes a compression stroke and a power stroke with the gas in the cylinder. Then the cylinder has an exhaust stroke at which time the exhaust valve, such as a valve 194, is opened and the combustion gases exit into the exhaust manifold 196. From the exhaust manifold 196, the exhaust gases flow through exhaust conduits, such as the conduit 198, and finally to the oxygen sensor 184, arriving there at time $t_2$. The output voltage then shifts to a high value representing a rich air/fuel mixture.

From the foregoing illustration, it can be seen that a changed fuel requirement at the throttle bores 108 and 110 is not immediately sensed by the oxygen sensor 184. This transport time delay T is complex in nature and varies with at least the speed of the engine 100 and the manifold absolute pressure. While the transport time T may vary from engine to engine, it may typically have a range from 0.5 to 1.5 seconds over the operating range of the engine.

If the initial and subsequently developed errors in the open loop calibration of the fuel controller 178 were substantially eliminated, the air/fuel ratio control errors associated with the closed loop circuit as a result of the system transport delay can be greatly reduced and even substantially eliminated. For example, the errors associated with adjusting the air/fuel ratio in response to conditions that previously existed is minimized. Further in the design of the closed loop controller, its gain may be optimized based on a relatively correct open loop calibration so as to reduce the amplitude of the limit cycle and therefore the magnitude of the air/fuel ratio excursions from a desired value. In accordance with the principles of this invention, the control box 178 includes a calibration learning control function which trims the error out of the open loop calibration during engine operation so as to accomplish this.

While the learning control of this invention is applicable with or without a closed loop control circuit, the calibration learning control function and the closed loop control circuit do cooperate to achieve a desired air/fuel ratio during all engine operating conditions to a degree that each individually may not achieve. For example, in addition to the allowed improved performance of the closed loop controller when the error is trimmed out of the open loop calibration, the closed loop controller minimizes the air/fuel ratio offset which at least temporarily results if, as in the embodiment hereinafter described, the open loop error is reduced over a period of time. Without the closed loop adjustment, this offset may result in a change in the conversion characteristics of a three-way catalytic converter resulting in an increase in the emission of at least one undesirable exhaust gas constituent.

Figure 7:
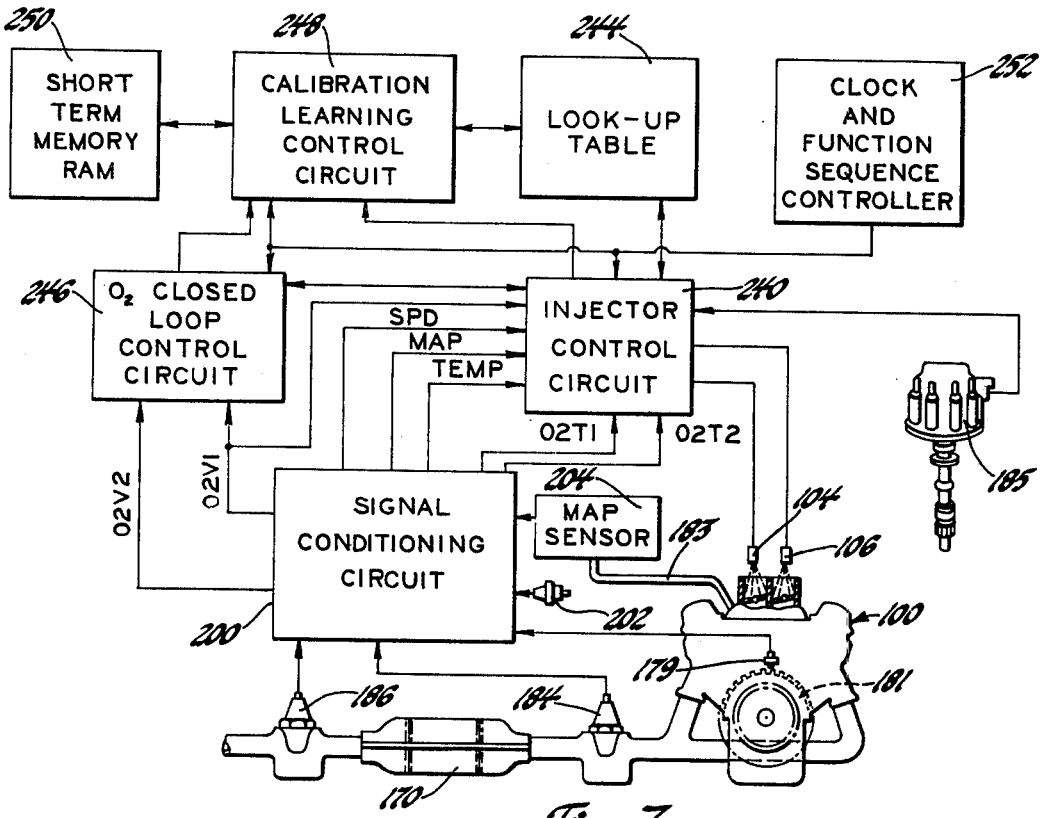
FIG. 7 is a diagram, partially in block form, showing the fuel injector control system of the preferred form of the present invention.

Referring to FIG. 7, the fuel controller 178 of FIG. 1 incorporating the principles of this invention is generally illustrated partially in block diagram form.

A signal conditioning circuit 200 receives the output voltage signals from the oxygen sensors 184 and 186, the speed pulses from the speed pickup 179, the output of an engine coolant temperature sensor 202 (which may take the form of a thermistor sensor) and the output of a manifold absolute pressure sensor 204 (which may take the form of a silicon strain gauge sensitive to the manifold absolute pressure coupled thereto through the tube 183). The signal conditioning circuit 200 is responsive to the respective inputs to provide the following voltage signals: a voltage 02V1 representing the output voltage of the oxygen sensor 184 upstream from the catalytic converter 170, a voltage 02V2 representing the output voltage of the oxygen sensor 186 downstream of the catalytic converter 170, a speed signal SPD comprised of a series of square wave pulses at a frequency corresponding to the frequency of the output signal from the speed sensor 172, a voltage signal MAP having a value representing the manifold absolute pressure, a voltage signal TEMP having a value representing the temperature of the coolant fluid in the engine 100, a voltage signal 02T1 representing the temperature of the oxygen sensor 184 and a voltage signal 02T2 representing the temperature of the oxygen sensor 186.

Figure 10:
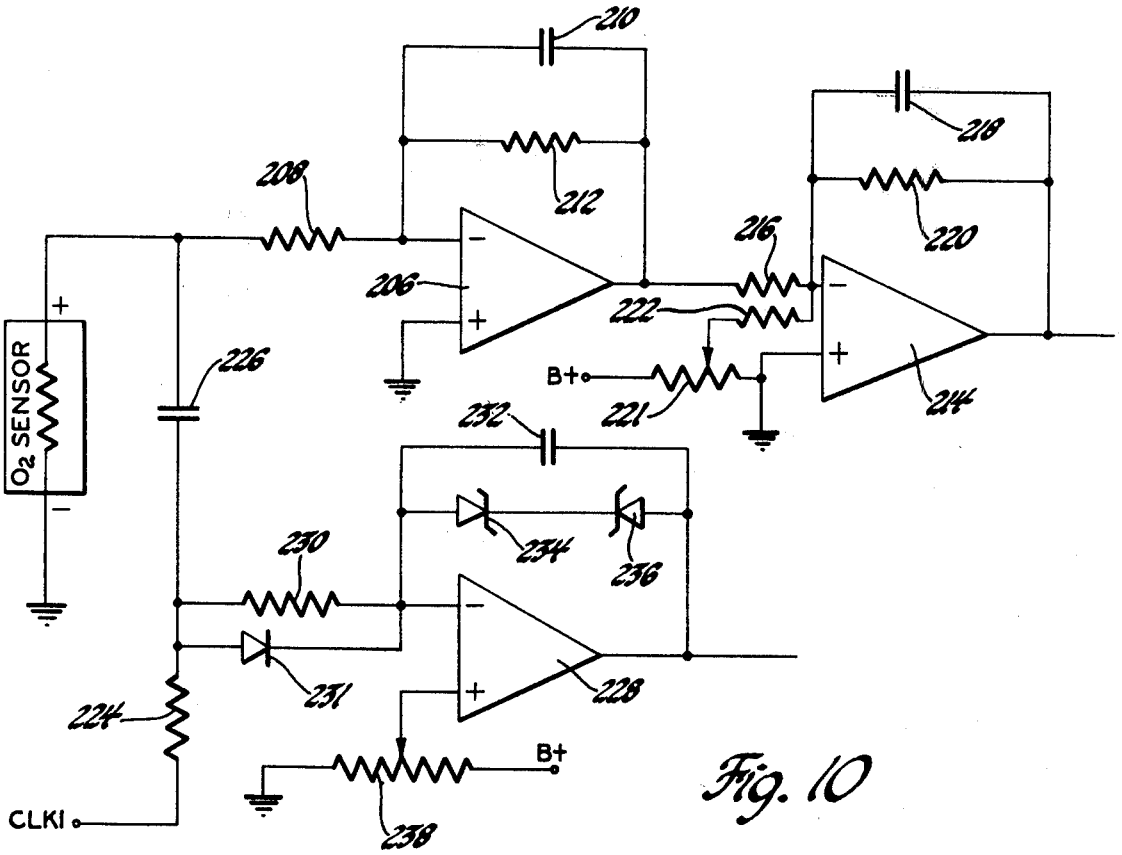
FIG. 10 is a circuit diagram of an embodiment of the portion of the signal conditioning circuit of FIG. 7 which provides an oxygen sensor output voltage and an oxygen sensor temperature signal.

FIG. 10 is an embodiment of the portion of the signal conditioning circuit 200 which provides the signal relating to the voltage output and the temperature of one of the oxygen sensors 184 and 186. The output voltage of the oxygen sensor is coupled to the negative input of an operational amplifier 206 through a coupling resistor 208. The positive input of the operational amplifier 206 is grounded. Feedback filtering elements including a capacitor 210 parallel coupled with a resistor 212 are coupled between the output of the operational amplifier 206 and its negative input to provide a low pass filter.

The output of the operational amplifier 206 is coupled to an inverter and scaling circuit including an operational amplifier 214. The signal path from the operational amplifier 206 to amplifier 214 may be traced through resistor 216. The positive input of the operational amplifier 214 is grounded. A feedback capacitor 218 is coupled in parallel with a feedback resistor 220 between the output of the amplifier 214 and its negative input, again providing linear performance and some time delay effect. Amplitude scaling is provided by a rheostat 221 coupled between a voltage B+ and ground, the output of the rheostat 221 being coupled to the input of the amplifier 214 through a resistor 222. The output voltage of the amplifier 214 comprises one of the output voltages 02V1 or 02V2.

The oxygen sensors 184 and 186, when of the zirconia electrolyte type, provide a useful output voltage indicative of the air/fuel ratio of the exhaust gases only when they are heated by the exhaust gases or other means to their operating temperature, which typically may be 700° F. These forms of oxygen sensors have an impedance which is inversely related to their temperatures so that the impedance of the sensor may be utilized to determine whether the sensor has attained its operating temperature. For example, a typical zirconia oxygen sensor may have an impedance of many megohms when cold and an impedance of 12 K ohms at an operating temperature of 700° F.

The circuit of FIG. 10 utilizes the relationship between the impedance of the zirconia oxygen sensor and its temperature to provide a signal which indicates whether the oxygen sensor is at or below its operating temperature. The circuit includes a resistor 224 and a capacitor 226 which are series coupled with the oxygen sensor. A square wave signal CLK1 is applied across the series combination of the resistor 224, the capacitor 226 and the oxygen sensor which form a voltage divider that provides a pulsating voltage at the junction between the resistor 224 and the capacitor 226 whose peak value is modulated by the impedance of the oxygen sensor. The peak amplitude of this pulsating voltage is therefore substantially proportional to the magnitude of resistance of the $O_2$ sensor and consequently substantially inversely proportional to its temperature. This voltage is coupled to the negative input of an operational amplifier 228 through the parallel combination of a resistor 230 and a diode 231. The operational amplifier includes a feedback capacitor 232 in parallel with a pair of reverse coupled Zener diodes 234 and 236. The latter limit the feedback voltage in the amplifier 228. A reference voltage provided by a rheostat 238 coupled between the supply voltage B+ and ground is coupled to the positive input of the amplifier 228. The resistor 230, diode 231 and the capacitor 232 form a peak detector that provides a voltage at the negative input of the amplifier 228 having a value generally substantially equal to the peak voltage output of the voltage divider formed by the resistor 224 and the oxygen sensor, representing the temperature of the oxygen sensor. The value of the reference voltage determined by the position of the movable terminal of potentiometer 238 is made equal to the voltage coupled to the negative terminal of the amplifier 228 when the oxygen sensor attains the operating temperature which, in the preferred embodiment, is 700° F.

When the oxygen sensor is heated by the exhaust gases from the internal combustion engine 100, its resistance decreases in accordance with its temperature. When the temperature of the oxygen sensor is below 700° F., the detected peak value of the voltage at the negative terminal of the amplifier 228 is greater than the reference voltage at the positive terminal so that the amplifier 228 provides a constant low level voltage output. When the sensor operating temperature of 700° F. is achieved, the detected peak voltage input to the amplifier 228 is less than the reference voltage supplied by the rheostat 238 and the amplifier 228 saturates to provide a constant high voltage output. The output of the amplifier 228, therefore, is a voltage signal having a constant low value when the oxygen sensor is cold and a constant high level when the oxygen sensor is hot.

The frequency of the square wave signal CLK1 is selected so as to be greater than the cutoff frequency of the low pass filter formed by the amplifier 206 and the feedback elements 210 and 212 so that the output of the amplifier 206 representing the output of the oxygen sensor is not influenced by the component of the voltage across the oxygen sensor resulting from the signal CLK1. In the preferred embodiment, the CLK1 signal has a frequency of 1,000 Hz.

Referring again to FIG. 7, the remaining portions of the signal conditioning circuit 200 are generally conventional in form. For example, the output of the speed sensor 179 may be supplied to a squaring amplifier internal to the circuit 200 which provides the square wave signal SPD to the injector control circuit 240 having a frequency representing the speed of the engine 100. The signal conditioning circuit components connected to the temperature sensor 202 may include a voltage divider or bridge circuit. The resistance of the temperature sensor 202 forms one leg of the circuit whose voltage output to the injector control circuit is representative of the resistance of the sensor and consequently temperature of the coolant fluid. Alternatively, the resistance of the sensor 202 could form the feedback gain controlling resistance of an amplifier within circuit 200 so that the output thereof represents the temperature of the coolant fluid. The output of the manifold absolute pressure sensor may be supplied, for example, to a signal conditioning amplifier which provides the voltage signal MAP representing the manifold absolute pressure to the injector control circuit 240.

The injector control circuit 240 functions to alternately energize the fuel injectors 104 and 106 so that fuel is delivered to the engine 100 once during every intake event in the preferred arrangement here described. For an eight-cylinder engine this results in four injection pulses per revolution of the engine. As previously indicated, the timing of the injection event is identified by the pulse output of the vehicle distributor 185.

The duration of each of the injection events required to achieve a stoichiometric air/fuel ratio is initially determined in open loop fashion and in accordance with an open loop calibration. In this respect, the injection control circuit 240 is responsive to the manifold absolute pressure voltage MAP to generally determine the mass of air entering each cylinder during each intake stroke in accordance with the expression (X).(MAP), where X is a constant taking into consideration the cylinder volume and a constant volumetric efficiency term. An energizing voltage pulse is supplied at each injection event. The time duration of the pulse is in accord with the term (X).(MAP) and the injector flow rate.

The injector control circuit 240 may additionally include correcting elements responsive to engine temperature, intake air temperature, engine speed and other factors as is common in the art.

However, the actual mass of air entering the cylinder will deviate from a value calculated from the manifold absolute pressure and a constant volumetric efficiency term. This is because the volumetric efficiency of an engine varies significantly over its operating range, and because of other factors. To compensate for this and other factors to be described, a trimming term (which, in the preferred embodiment is a percentage figure with 0 being 100%, a minus value being a percentage less than 100% and a plus value being a percentage greater than 100) is provided in the injector control circuit 240. This term has a value determined by the engine operating parameters. The trimming term varies the otherwise determined duration of the injection voltage pulse in amount and direction to more closely achieve the desired near-stoichiometric air/fuel ratio. In the preferred embodiment the value of the trim term is determined from the instantaneous values of engine speed and manifold absolute pressure. If desired, the trim term may additionally use the value of the engine coolant temperature or other pertinent parameters that affect the engine fuel requirement.

The trimming term is provided for each set of trim term determining engine operating conditions (e.g., engine speed, MAP). A trimming factor look-up table 244 has a random access memory (RAM) which may be, for example, a 16 × 16 matrix having 256 addressable word storage locations. Each of the storage locations is addressable as a function of a specific combination of manifold absolute pressure and engine speed (for example) and contains a stored word representing the value of the trimming term for the particular combination of engine operating parameters. The injector control circuit 240 recurrently addresses the look-up table 244 in response to the sampled values of the engine speed and manifold absolute pressure, at the address defined by these parameters, retrieves the stored trimming term, and trims the determined value of the injection duration in amount and direction according to the trimming value thus retrieved.

The trimming values initially stored at each of the storage locations in the look-up table 244 are determined as a function of the most common characteristics of a particular engine type. All or part of the stored values may be erroneous for a particular engine and, in any event, become erroneous due to changes with time. Thus, manufacturing tolerances may result in valve opening and closing time variances, compression ratio variations, EGR value operation deviations, and in exhaust back pressure variances making the initially stored trimming value incorrect. Manufacturing tolerances in the sensing devices such as the manifold absolute pressure sensor 204 have a similar effect. Additionally, the characteristics of an engine at any particular operating point will vary unpredictably over its operating life as a result of wear, buildup of deposits and other system changes. The initially stored trimming values accordingly require updating from time to time.

In the preferred form of the invention an $O_2$ closed loop control circuit 246 is responsive to the oxygen sensor voltages 02V1 and 02V2 representing a sensed air/fuel ratio to provide a closed loop signal containing integral plus proportional terms generated in response to the sensed deviation of the air/fuel ratio from stoichiometry. This closed loop signal is utilized by the injector control circuit 240 to further adjust the determined injection duration in a sense and direction to correct the sensed air/fuel ratio error. A calibration learning control circuit 248 is provided which functions to trim out the open loop calibration errors introduced from all sources including manufacturing tolerances in the engine and sensors and hardware changes over the operating life of the engine. While the calibration learning control may operate without a closed loop controller, the calibration learning control circuit 248 and the closed loop control circuit 246 cooperate to achieve precise control of air/fuel ratio under all operating conditions as previously described.

In the preferred embodiment, the calibration learning control circuit 248 currently samples various operating parameters, including the address (determined by the engine parameters) last used by the injector control circuit 240 in addressing the trimming factor look-up table 244, the trimming factor used by the injector control circuit and certain parameters within the closed loop control circuit 246, at intervals substantially less than the transport delay, i.e., 40 milliseconds, and causes this data to be stored in a sequential memory location in a short term random access memory (RAM) 250. The short term memory RAM 250 then contains the most recent history of the engine operation. The number of memory locations in the memory 250 is such that the recorded history covers a time period at least equal to the maximum transport delay time through the engine as previously discussed. For example, if the maximum transport delay time is 1.5 seconds and the sampling interval is 40 milliseconds, at least thirty-eight memory locations would be required.

The calibration learning control circuit 248 recurrently samples the air/fuel ratio error as determined by the output of the oxygen sensor 184 and the $O_2$ closed loop control circuit 246 once for each of the sampling events used in the short term memory 250 and, by determining the transport delay T, relates the error in time to the previously existing engine operating parameters and associated trimming factor stored in the short term memory 250 which resulted in the sensed error. A new trim factor is then calculated and stored in the memory location in the look-up table 244 addressable by the previously existing engine operating parameters. The revised trimming factor varies from the replaced trimming factor in a sense to reduce the open-loop calibration error at the previously existing engine operating point and such revised trimming factor is then available for trimming the injection duration determined by the control circuit 240 when the engine next returns to that operating point.

The system of FIG. 7 includes a clock and sequence controller 252 which generates sequential command signals which cause the injector control circuit 240, the $O_2$ closed loop control circuit 246 and the calibration learning control circuit 248 to perform their functions in a sequential and cyclic manner. In the preferred embodiment of the invention, the clock and sequence controller 252 causes the injector control circuit 240 to sample the engine operating point and determine the required injection duration on a 10 msec. cyclic basis and as previously indicated, causes the calibration learning control circuit 248 to perform the calibration learning function on a 40 msec. cyclic basis.

Figure 8:
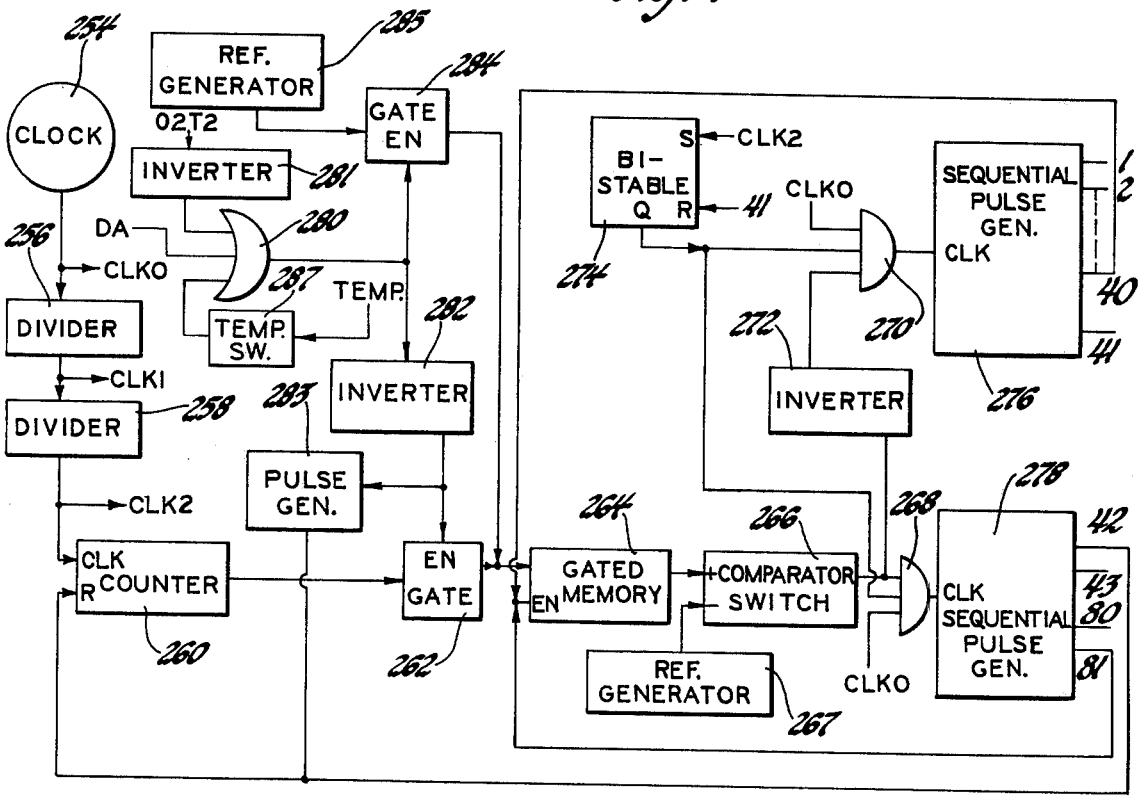
FIG. 8 is a diagram of the preferred form of the command signal generator for controlling the operation of the fuel control system.

Referring to FIG. 8, there is illustrated one form of the clock and sequence controller 252 of FIG. 7 which functions to provide sequential command signals for controlling the operation of the injector control circuit 240, the $O_2$ closed loop control circuit 246 and the calibration learning control circuit 248.

High frequency square wave clock pulses CLK0 are generated by a clock 254. A divider 256 functions to divide the frequency of the clock pulses CLK0 to a lower frequency square wave clock pulse CLK1 having a frequency of, for example, 1 kHz. This clock signal may be used in the oxygen sensor impedance measuring circuit of FIG. 10 as previously described. The clock pulses CLK1 are further divided down frequency by a divider 258 whose output is comprised of square wave clock pulses CLK2 having a frequency of 100 Hz in the preferred embodiment and consequently having a period of 10 milliseconds.

The clock pulses CLK2 are counted by a counter 260 whose net count, hereinafter referred to as the index number, is coupled to the input of a gate 262. The output of the gate 262 is coupled to the data input of a gated memory 264 which functions to sample and store an input number applied thereto when a pulse is applied to its enable input.

The stored number in the gated memory 264 is coupled to the positive input of a comparator switch 266 which receives a reference index number (three in the preferred embodiment) at its negative input from a reference number generator 267. The output of the comparator switch 266 is a logic 1 level when its positive input represents a number greater than the reference number applied to its negative input. When the number applied to its positive input is equal to or less than the reference number, the output of the comparator switch 266 is a digital logic 0 level.

The logic level output of the comparator switch 266 is coupled to an input of an AND gate 268 and to an input of an AND gate 270 through an inverter 272.

A bistable flip-flop 274 is set once each 10 msec. by the clock pulses CLK2. The Q output of the flip-flop 274 and the high frequency clock pulse CLK0 are coupled to respective inputs of the AND gates 268 and 270. The output of the AND gate 270 is coupled to the clock input of a sequential pulse generator 276 and the output of the AND gate 268 is coupled to the clock input of a sequential pulse generator 278. The sequential pulse generators 276 and 278 are of the known type of shift register that produces a sequential pulse output and which may include inverters to obtain the logic 1 pulse which is shifted sequentially through their output lines in response to clock pulses applied to their clock inputs. Each logic 1 pulse provided by the pulse generators 276 and 278 represents a unique system command signal.

The sequential pulse generator 276 is controlled so as to generate a series of sequential command signals 1 through 41 once each 10 msec. The sequential pulse generator 278 is controlled so as to generate sequential command signals 42 through 81 once each 40 msec.

Assuming the enable to the gate 262 is a continuous logic 1 level, the counter 260 is reset, the memory 264 contains a number equal to or less than three and the flip-flop 274 reset, the sequential command signals are generated as follows: Upon the occurrence of a clock pulse CLK2, the counter 260 is clocked to provide an index number one and the flip-flop 274 is set so that Q output shifts to a logic 1 level. Since the output of the comparator switch 266 is a logic 0 level, the AND gate 268 is disabled. However, the input to the AND gate 270 from the inverter 272 is a logic 1 level so that upon the occurrence of each of the clock pulses CLK0, the AND gate provides a clock pulse to clock the sequential pulse generator 276 which generates the sequential command signals 1 through 40 at the frequency of the clock pulses CLK0. The command signal 40 enables the gated memory 264 to sample the index number from the counter 260 coupled thereto through the gate 262. However, as the index number is one, the output of the comparator switch 266 remains a digital logic 0 so that the clock pulse CLK0 continues to clock the sequential pulse generator 276 which generates the command signal 41. The command signal 41 is coupled to the reset input of the flip-flop 274 which is reset to disable the AND gate 270 to terminate the clocking of the generator 276. No further command signals are generated until next clock pulse CLK2 again clocks the counter 260 and sets the flip-flop 274 after which the sequence is again repeated.

When the fourth clock pulse CLK2 is generated so that the index number provided by the counter 260 is four, the output of the comparator switch 266 is shifted to a logic 1 level when the command signal 40 enables the gated memory 264 to sample the index number. The AND gate 270 is therefore disabled and the AND gate 268 is enabled to provide clock pulses to the sequential pulse generator 278 at the frequency of the clock pulses CLK0. The sequential pulse generator 278 therefore generates the command signals 42 through 81. The first command signal 42 provided by the generator 278 functions to reset the index number in the counter 260 to zero and the last command signal 81 provided by the generator 278 functions to enable the gated memory 264 to sample the counter 260 resulting in the output of the comparator switch 266 shifting to a logic 0 to again enable the AND gate 270. Thereafter, clock pulses CLK0 are supplied to the clock input of the sequential pulse generator 276 which proceeds to generate the remaining command signal 41.

In the preferred embodiment, the sequential command signals provided by the sequential pulse generator 276 repeat every 10 msec. and function to control the injector control circuit 240 and portions of the $O_2$ closed loop control circuit 264 and the sequential command signals provided by the sequential pulse generator 278 repeat every 40 msec. and function to control the calibration learning control circuit 248 and a portion of the $O_2$ closed loop control circuit 246.

During certain operating conditions of the vehicle, it may be desired to disable the calibration learning control 248. For example, during cold operation, acceleration, deceleration or hot engine restart, it may be desirable to operate the engine other than at the stoichiometric air/fuel ratio. During these periods when the injector control circuit 240 of FIG. 1 schedules an air/fuel ratio other than stoichiometry, the calibration learning control circuit 248 would function to adjust the trim factors in the look-up table 244 in accord with the deviation of the air/fuel ratio from stoichiometry. Thereafter when the injector control circuit 240 again schedules a stoichiometric ratio, the adjusted trim factors would be in error. Additionally, in those vehicles that have a fuel vapor trap, such as an activated carbon canister, it may be desirable to disable the learning control circuit 248 during the periods where the trap is being purged of fuel vapors which are coupled to the engine air/fuel intake space. During the period of the purge, the air/fuel ratio becomes rich and the calibration learning control circuit 248, if operative, would function to adjust the trim factors in the look-up table 244 in a fuel decreasing direction even though the previously existing trim factor may have been correct. In the present embodiment, the vehicle includes a typical activated charcoal trap (not illustrated) from which the fuel vapor purge generally is most significant when the engine is first started or when the vehicle is operating under extreme heat conditions. To prevent calibration learning during these periods, the calibration learning control circuit may be disabled, for example, when the engine coolant temperature is less than 180° F. or greater than 210° F. which are representative of the aforementioned purge conditions. In another embodiment, the fuel vapor purge may be selectively controlled. In this embodiment, the signal controlling the purge may also be used to disable the calibration learning control circuit 248.

To disable the calibration learning control circuit 248 during the aforementioned conditions of engine operation, a circuit is provided to disable the gate 262 so that the sequential pulse generator 278 is prevented from generating the command signals which control the calibration learning control circuit 248. This circuit includes an OR gate 280 which receives a disable signal DA from the injector control circuit 240 during the time periods that an air/fuel ratio other than stoichiometry is scheduled. The OR gate 280 further receives a signal which is an inverted form of the sensor 186 temperature signal 02T2 from an inverter 281. This signal is a logic 1 level when the temperature of the oxygen sensor 186 is below its operating temperature. Additionally, a temperature switch 287 monitors the coolant temperature as represented by the output signal TEMP of the sensor 202 (FIG. 7) and supplies a logic 1 level to the gate 280 when the coolant temperature is below the value such as 180° F. which is representative of a vapor trap purge condition and when the coolant temperature is above the value such as 210° F. which is also representative of a vapor trap purge condition. The switch 287 may take the form of a pair of comparators that are well known in the art, each of which compares the temperature signal TEMP to a reference signal corresponding a respective one of the temperatures 180° F. or 210° F. to provide the logic 1 level described above. The output of the OR gate 280 is a logic 1 level during the period of a disable signal DA, when the oxygen sensor 186 is below its operating temperature or during the period that the fuel vapor trap is purging. The OR gate 280 output is used to disable the operation of the learning control circuit 248 until the sensor 186 downstream of the converter 170 attains its operating temperature, any time an air/fuel ratio other than stoichiometry is scheduled and during the purge periods of the fuel vapor trap. This is accomplished by coupling the output of the OR gate 280 to the enable input of the gate 262 through an inverter 282 so as to disable the gate 262 during the period of the disable signal DA or while the signal 02T2 is in its low level state. Additionally, signals such as previously described representative of the purging of the fuel vapor trap may be coupled to the OR gate 280 to disable operation of the learning control circuit 248.

During the time that the gate 262 is disabled, the OR gate 280 functions to enable a gate 284 to couple an artificial index number stored within a circuit 285 to the data input of the gated memory 264. This reference index number has a value which is less than or equal to the reference number provided by the reference number store 267 so that when the gated memory 264 is enabled by the command signals 40 or 81 to sample the index number, the comparator switch 266 will supply a logic 0 output to disable the AND gate 268. In this manner, as long as the OR gate 280 supplies the logic 1 level, the sequential pulse generator 278 is prevented from generating sequential command signals, However, the sequential pulse generator 276 continues to function so that the injector control circuit 240 continues to function to control the fuel injectors 104 and 106. When the output of the OR gate 280 again shifts to a logic 0 level, the gate 284 is disabled, the gate 262 is enabled and the counter 260 is reset by the output of a monostable flip-flop 283 which is triggered by the logic 0 to logic 1 level transition. Thereafter, the sequential pulse generator 278 functions each 40 msec. as previously described.

Generally the circuitry of FIG. 8 develops sequential pulses 1 through 41 at 10 msec. intervals for three consecutive intervals. On the fourth 10 msec. interval, the pulses 1 through 40, 42 through 81 and 41 are sequentially generated. This cycle is repeated every 40 msec.

Figure 9:
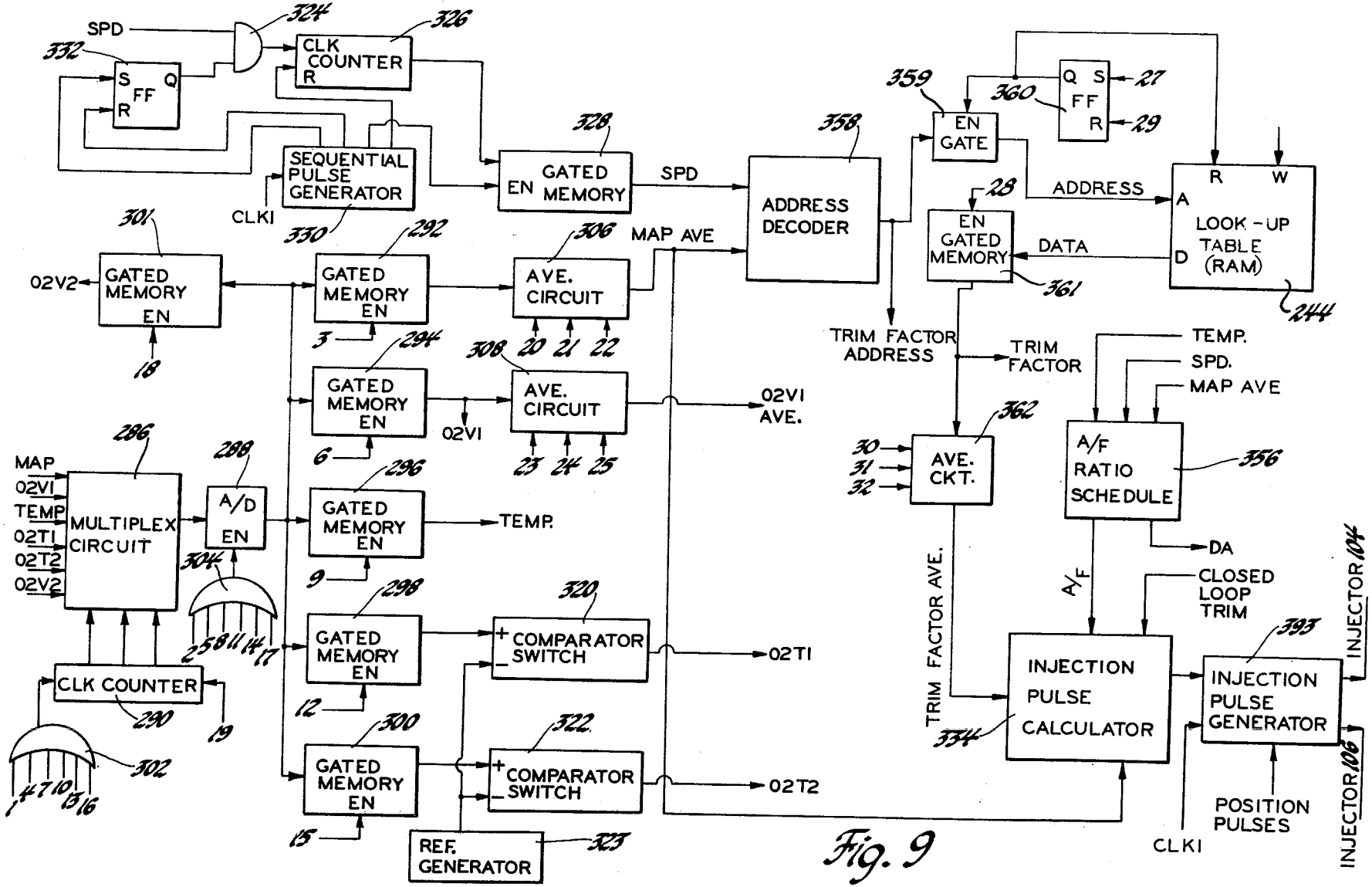
FIG. 9 is a block diagram illustrating the open loop control portion of the injector control circuit of FIG. 7.

Referring to FIG. 9, the sequential pulse generator 276 first commands the injector control circuit 240 to sample and hold the various analog voltages. In this resect, the injector control circuit includes a multiplex circuit 286 which receives the analog voltage signals MAP, 02V1, TEMP, 02T1, 02T2 and 02V2. The multiplex circuit 286 is instructed to pass a selected one of the analog voltages to the input of an analog-to-digital converter 288 as a function of a binary code provided by a counter 290. The output of the analog-to-digital converter 288 is coupled to the respective inputs of a number of gated memories 292, 294, 296, 298, 300 and 301, each being associated with one of the data inputs to the multiplex circuit 286.

The command signals 1 through 18 control the sample and hold sequence. In this respect, the command signals 1, 4, 7, 10, 13 and 16 are coupled to respective inputs of an OR gate 302 whose output is coupled to the clock input of the counter 290. Further, the command signals 2, 5, 8, 11, 14 and 17 are coupled to respective inputs of an OR gate 304 whose output is coupled to the enabling input of the analog-to-digital converter 288. The command signals 3, 6, 9, 12, 15 and 18 are coupled to the respective enabling inputs of the gated memories 292 through 301.

Assuming the counter 290 in the reset condition, the command signal 1 functions to clock the counter 290 to provide a binary code which causes the multiplex circuit 286 to couple the analog signal MAP representing the manifold absolute pressure to the input of the analog digital converter 288. The command signal 2 enables the analog-to-digital converter 288 to convert the signal to a digital word representing the magnitude of the MAP signal. The command signal 3 then enables the gated memory 292 to memorize the digital word representing the magnitude of the manifold absolute pressure. In the same manner, the remaining analog voltages are converted to respective digital words and memorized in the gated memories 294 through 301. Following the command signal 18, a command signal 19 resets the counter 290 so that the circuit is again in condition to sample and hold the values of the inputs to the multiplex circuits 286 when the command signals 1 through 18 are again provided.

Since the manifold absolute pressure varies as a function of the intake valves opening and closing, the preferred embodiment of the invention utilizes an average manifold absolute pressure in determining the fuel requirement of the vehicle engine. Further, as will be discussed with reference to the calibration learning control circuit 248, the average value of the output voltage 02V1 of the oxygen sensor 184 is utilized.

Following the sample and hold sequence, the sequential pulse generator 276 next commands a pair of averaging circuits 306 and 308 to average the output of the gated memory 292 representing the value of the manifold absolute pressure and the output of the gated memory 294 representing the magnitude of the voltage 02V1. While the averaging circuits 306 and 308 may use any desired technique, they may each take the form of the averaging circuit illustrated in FIG. 11. For purposes of illustration, the averaging circuit of FIG. 11 will be assumed to be the averaging circuit 306 providing an output representing the average manifold absolute pressure MAPAVE.

Figure 11:
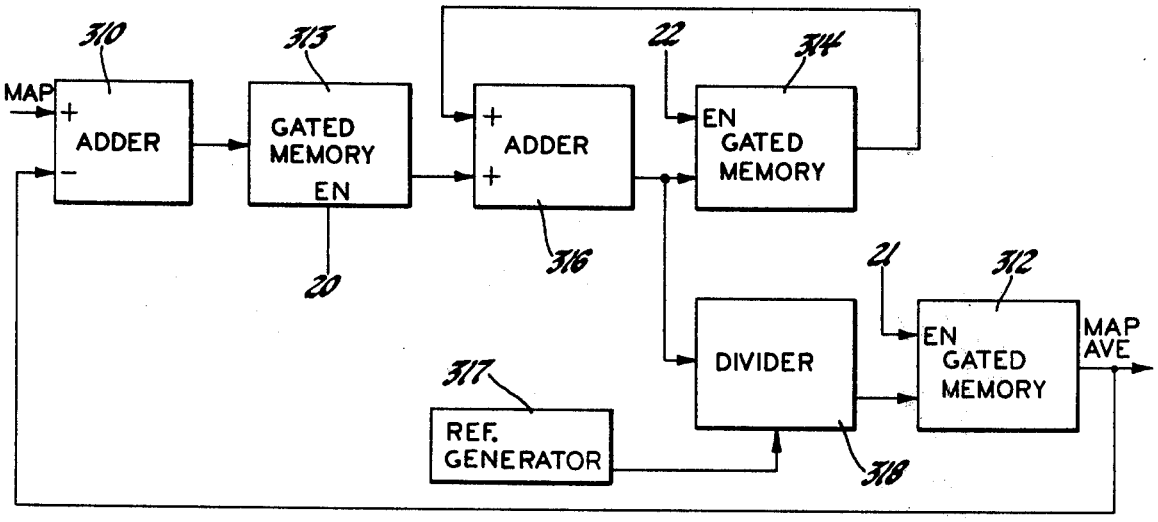
FIG. 11 is a diagram of an illustrative averaging circuit for use in the system of FIG. 8.

The averaging circuit of FIG. 11 generally satisfies the expression NEW SUM/CONSTANT, where the new sum is equal to the old sum plus the new value of the parameter being averaged minus the old average and where the constant determines the time constant of the averaging circuit. An adder 310 receives the output of the gated memory 292, FIG. 9, representing the last sampled value of the manifold absolute pressure and subtracts from it the old average value of manifold absolute pressure MAPAVE at the output of a gated memory 312 which was determined during the previous commanded averaging sequence. This difference is stored by a gated memory 313 when enabled by the command signal 20. The stored difference is added to the output of a gated memory 314 by an adder 316. The output of the memory 314 comprises the previously summed value at the output of the adder 316. The output of the adder 316 is divided by a reference number (the constant in the foregoing expression) provided by a reference generator 317 in a divider 318. In this embodiment, the reference generator 317 provides the reference number 4 to the divider 318. This average is then gated into the gated memory 312 by the command signal 21. The next command signal 22 enables the gated memory 314 to memorize the output of the adder 316 so that the circuit is then in condition for providing a new value of average manifold absolute pressure when the next averaging routine is again commanded by the sequential pulse generator 276.

Similarly, the sampling pulses 23, 24 and 25 thereafter command the averaging circuit 308 to generate an average value of the output voltage 02V1 of the sensor 184. In this embodiment, the time constant of the averaging circuit 308 is the same as the time constant of the averaging circuit 306.

A pair of comparator switches 320 and 322 compare the outputs of the gated memories 298 and 300 with a reference value provided by a reference generator 323 that is intermediate the minimum and maximum output values of the amplifier 228 in FIG. 10 so as to provide a logic signal changing abruptly when the respective oxygen sensors attain their operating temperature. In this respect, the voltage signals 02T1 and 02T2 at the output of the switches 320 and 322 shift from a logic zero level to a logic 1 level when the respective oxygen sensors 184 and 186 attain the operating temperature of 700° F.

A digital word representing the instantaneous speed of the engine 100 is provided by a circuit which operates asynchronously with the command signals provided by the sequence controller 252. This circuit includes an AND gate 324 which gates the speed pulses SPD to the clock input of a counter 326 for a specified time duration which may be, for example, 12 milliseconds. At the end of the counting period, the count contained in the counter 326 represents the instantaneous speed of the engine 100. This count is memorized by a gated memory 328.

The counter 326 and the gated memory 328 are controlled by means of a sequential pulse generator 330 clocked by the clock pulses CLK1 and a flip-flop 332. The sequential pulse generator 330 is substantially identical to the sequential pulse generators 276 and 278 of FIG. 8 but which only generate a sequence of, for example, fifteen pulses having one msec. spacing. The first pulse functions to set the flip-flop 322 whose Q output shifts to a logic 1 to gate the speed pulses through the AND gate 324 to the clock input of the counter 326. Twelve msec. later, the thirteenth pulse operates to set the flip-flop 332 to disable the AND gate 324. The net count in the counter 326 representing engine speed is then gated into the gated memory 328 by the next pulse provided by the generator 330. Thereafter, the final pulse in the sequence resets the counter 326. The sequence is then repeated so as to continually provide a binary word at the output of the gated memory 328 representing the instantaneous speed of the vehicle engine 100.

Following the averaging routine for obtaining an average value of the manifold absolute pressure and the average value of the sensor voltage 02V1, the sequential pulse generator 276 next commands an injection pulse calculator 334 to determine the mass of air inducted into each cylinder of the engine 100 during the intake event. The portion of the injection pulse calculator 334 which determines the mass of air for each intake event is illustrated in FIG. 12.

Figures 12, 13:
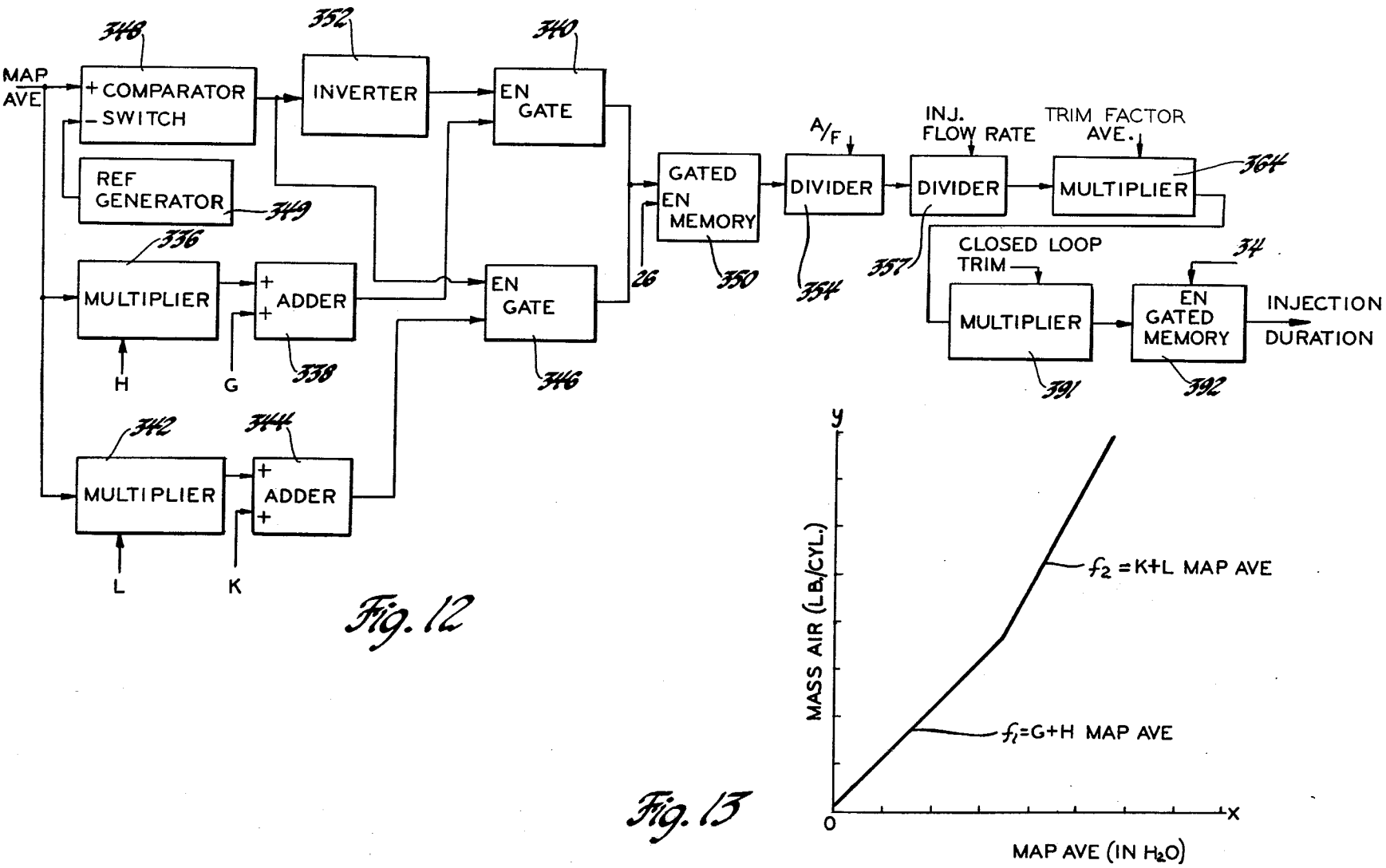
FIG. 12 is a block diagram of a portion of the injection pulse calculator of FIG. 3 which provides an injection duration signal.
FIG. 13 is a graph illustrating the function employed in the circuit diagrammatically shown in FIG. 11 for determining the mass air per cylinder of the vehicle engine.

The system of FIG. 12 determines the mass of air entering the cylinder on each intake event by implementing the functions represented by the curve of FIG. 13. In FIG. 13, the mass of air entering a cylinder during an intake event is plotted against the calculated average value MAPAVE of the manifold absolute pressure of the engine 100. While the actual mass of air entering the cylinder during each intake event is generally described by a complex nonlinear curve, the nonlinear curve is approximated by two straight line segments represented by the respective functions $f_1 = G+H \cdot MAPAVE$ and $f_2 = K+L \cdot MAPAVE$, where the values of G and K represent the Y axis intercept values and the values of H and L represent the respective slopes of the straight line segments.

The curve of FIG. 13 is implemented by the system of FIG. 12 which includes a multiplier 336 which multiplies the average manifold absolute pressure value from the averaging circuit 306 of FIG. 9 by the slope constant H of the function $f_1$. The resulting value is added to the y axis intercept value G of the function $f_1$. The output of the adder 338, representing the mass of air intake per cylinder on each intake event over the range of the curve segment defined by the function $f_1$, is coupled to the input of a gate 340.

A multiplier 342 multiplies the average manifold absolute pressure by the slope constant L of the function $f_2$. The output of the multiplier is added to the y intercept value K of the function $f_2$. The resulting value representing the mass of air per cylinder during each intake event over the range of the curve segment defined by the function $f_2$ is coupled to the input of a gate 346. The particular function $f_1$ or $f_2$ is selected by means of a comparator switch 348 which compares the magnitude of the average manifold absolute pressure with a reference value provided by a reference generator 349 that is equal to the average value manifold absolute pressure at the intersection of the two straight line segments. When the value of the average manifold absolute pressure is greater than the reference value, the output of the comparator switch 348 is a logic 1 level which enables the gate 346 to pass the output of the adder 344. When the average value of the manifold absolute pressure is less than the reference value, the output of the comparator switch 348 enables the gate 340 via an inverter 352 to couple the output of the adder 338 to the gated memory 350. The determined mass of the air entering a cylinder of the engine 100 on each intake event is sampled and stored by the gated memory 350 when the command pulse 26 is provided by the sequential pulse generator 276.

The output of the gated memory 350, representing the mass of air entering each cylinder, is divided by a value representing a scheduled air/fuel ratio in a divider 354 to determine the amount of fuel required to achieve the scheduled air/fuel ratio. During normal operation of the engine 100, the scheduled air/fuel ratio applied to the divider 354 is a value generally representing a stoichiometric air/fuel ratio and may be, for example, 14.7. However, during certain operating conditions of the engine 100, it may be desirable to provide for an air/fuel ratio varying from a ratio approximating stoichiometry. The desired A/F ratio is provided by an air/fuel ratio schedule circuit 356 (FIG. 9) which normally provides a value representing stoichiometry and which is responsive to the engine coolant temperature, engine speed and average manifold absolute pressure to provide an air/fuel ratio schedule varying from stoichiometry and to provide the disable signal DA during certain operating conditions such as cold engine operation, certain engine acceleration levels, engine deceleration and hot engine restart. The desired scheduled air/fuel ratio from the air/fuel ratio schedule circuit 356 is supplied to the divider 354 of FIG. 12. Unless otherwise indicated, it will be assumed in the following description that the air/fuel ratio schedule applied to the divider 354 is a value such as 14.7 which generally represents a stoichiometric air/fuel ratio.

The output of the divider 354 representing the determined amount of fuel for each injection event is coupled to the input of a divider 357 which divides the required fuel amount by a value representing the fuel flow rate of each of the injectors 104 and 106 to provide a digital word which generally represents the duration of each injection event to produce a stoichiometric air/fuel ratio.

Referring again to FIG. 9, the sequential pulse generator 276 next commands the system to determine the trimming factor at the particular engine operating parameters for adjusting the injection duration value at the output of the divider 357 so as to provide an injection duration which more closely produces a stoichiometric air/fuel ratio.

The trimming factor at a particular engine operating point is obtained by means of an address decoder 358 which decodes the operating point of the vehicle engine 100 as represented by the average manifold pressure and the instantaneous engine speed. The address decoder 358 decodes the values of average manifold absolute pressure and engine speed and generates a look-up table address which is used to address the storage location in the look-up table 244 containing the word representing the trimming factor applicable to the current vehicle operating conditions. The address provided by the address decoder 358 is supplied to a gate 359 which is enabled by the Q output of a flip-flop 360. The command signal 27 sets the flip-flop 360 whose Q output shifts to a logic 1 level to enable the gate 359 to couple the address provided by the decoder 358 to the address input lines of the look-up table 244. At the same time, the Q output of the flip-flop 360 instructs the look-up table 244 to read the word respresenting the trimming factor at the address provided by the decoder 358. The trimming factor at the addressed location is thus recalled and is provided at the data lines of the look-up table 244. The data lines are coupled to a gated memory 361 which is enabled by the command signal 28 to store the recalled trimming factor applicable to the current vehicle operating conditions. The command signal 29 thereafter resets the flip-flop 360 whose Q output shifts to a logic 0 level to disable the gate 359 and to remove the read command to the look-up table 244.

In the preferred embodiment the trim factors stored in the look-up table 244 are in the form of signed numbers representing percentage adjustments. A trim factor of zero represents 100% or no trim, a positive trim factor represents a percentage greater than 100% to effect an increase in the fuel supply rate, and a negative trim factor represents a percentage less than 100% to effect a decrease in the fuel supply rate. In one embodiment, a change in one count in the trim factor represents a 0.25% change in the fuel flow rate. Therefore, a trim factor represented by the number +40 would represent 110% (a required 10% increase in the fuel flow rate) whereas the number −40 would represent 90% (a required 10% decrease in the fuel flow rate).

The trimming factor recalled from the look-up table 244 is coupled to an averaging circuit 362 which takes the form of the averaging circuit illustrated in FIG. 11 with, however, the reference generator 317 containing the reference number 2 so that the time constant of the averaging circuit 362 is less than the time constants of the averaging circuits 306 and 308. The averaging circuit 362 is responsive to the command signals 30, 31 and 32 to provide the trimming factor to be used by the injection pulse calculator 334 in determining the injection duration for obtaining a stoichiometric air/fuel ratio.

The trimming factor used by the calculator 334 in the preferred embodiment is an average trimming factor so as to prevent an abrupt change in the injection duration determined by the calculator 334 if the trim factors at consecutive addressed locations substantially differed. It is understood, however, that the trimming factor may be used with or without averaging as desired.

Referring again to FIG. 12, the determined trimming factor is coupled to a multiplier 364 which trims the output injection duration determined by the divider 357 in magnitude and direction in accord with the percent change represented by the trim factor so as to more closely achieve a stoichiometric air/fuel ratio. The word output of the multiplier 364 represents the open loop determination of the injection duration required in order to achieve stoichiometric air/fuel ratio. While the injection duration represented by the output of the multiplier 364 may be used in the control of the injectors 104 and 106, the preferred embodiment adjusts this duration value by the closed loop control circuit 246.

Following the open loop determination of the injection duration by the circuit of FIG. 12, the function sequence controller of FIG. 8 commands the $0_2$ closed loop control circuit 246 of FIG. 7 to determine a closed loop fuel adjustment from the sensed air/fuel ratio error for adjusting the open loop determined injection duration.

Figure 14:
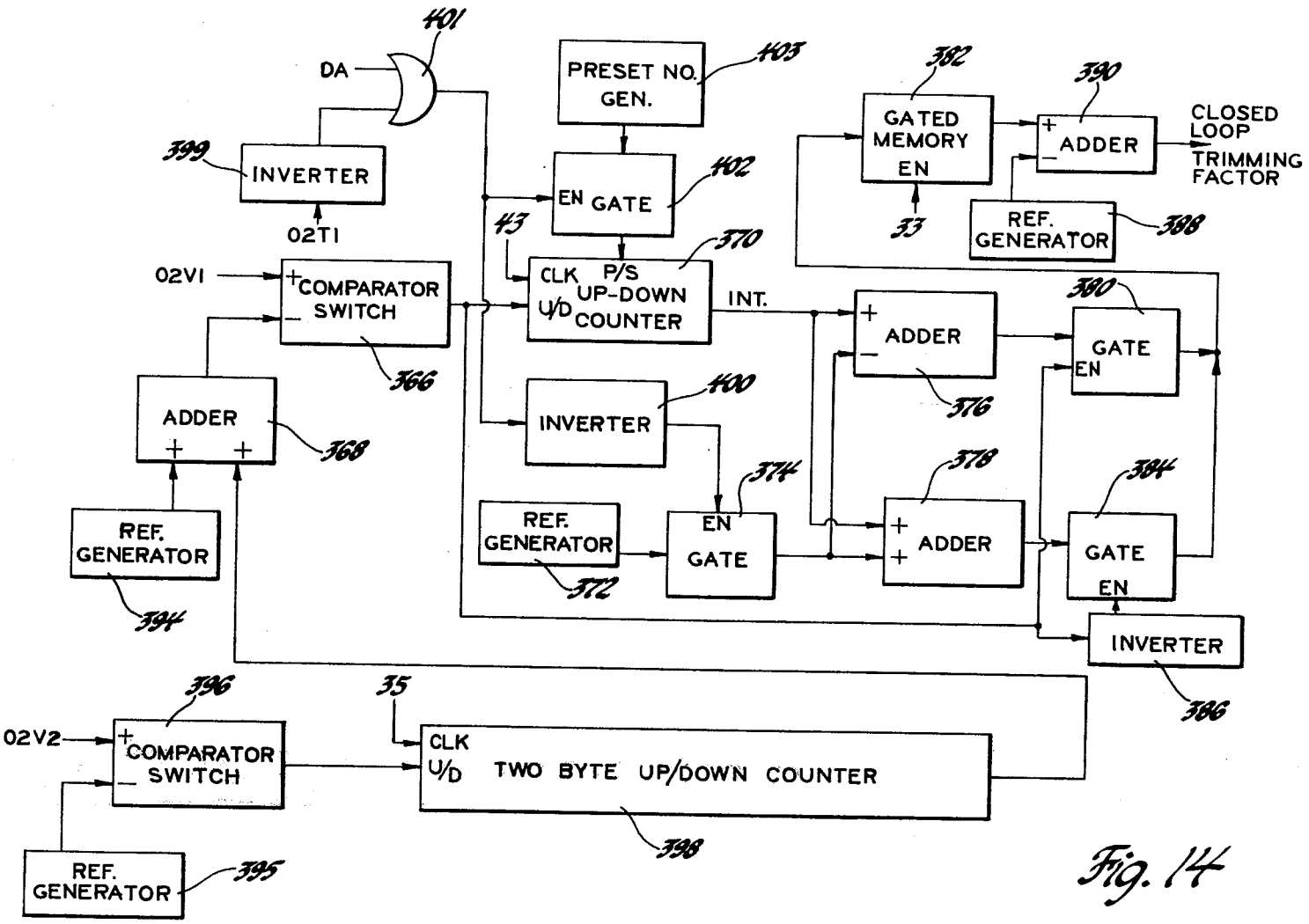
FIG. 14 is a block diagram of an embodiment of the $O_2$ closed loop control circuit usable with a fuel control system of the type shown in FIG. 1.

Referring to FIG. 14, the closed loop fuel control circuit generally takes the form of the closed loop fuel control system described in U.S. Pat. No. 3,939,654, which issued on Feb. 24, 1976 to Wendell D. Creps and which is assigned to the assignee of this invention. The closed loop fuel control system of FIG. 14 includes an integral plus proportional controller responsive to the output signal of the exhaust gas sensor 184 upstream of the catalytic converter 170. The exhaust gas sensor 186 downstream of the catalytic converter functions to control the operating point of the integral plus proportional controller. While reference may be made to the above-mentioned patent in order to obtain the particulars of the preferred form of controller used in this invention, it is sufficient for purposes of this description to note that the oxygen sensor 186 downstream of the catalytic converter 170 exhibits sharper sensitivity to a change in the air/fuel ratio and provides a signal which may be used to maintain the system within the narrow range at stoichiometry over time without drift while the first sensor 184 provides a quicker response, since it does not involve the time delay introduced by the catalytic converter 170, which reduces transient swing out of the narrow range at stoichiometry at which maximum converter efficiency results and helps reduce the required gain in the feedback loop to improve the stability of the closed loop system.

Referring now to FIG. 14, the closed loop control circuit includes a comparator switch 366 which compares the output voltage 02V1 from the gated memory 294 of FIG. 9, which represents the output of the oxygen sensor 184, with a reference level supplied by an adder 368. The reference level output of the adder 368 represents the value of 02V1 when the air/fuel ratio is at stoichiometry. Consequently, the output of the comparator switch 366 is a logic 1 level when the sensed air/fuel ratio is richer than stoichiometry and a logic 0 level when the air/fuel ratio is leaner than stoichiometry.

The output of the comparator switch 366 is coupled to the up/down control input of an up/down counter 370 which functions as an integrator producing an integral correction term INT. The up/down counter 370 is clocked by one of the command signals produced by the sequential pulse generator 278 every 40 milliseconds as will subsequently be described. When the comparator switch 366 is at a logic 1 level representing a rich air/fuel ratio, the up/down counter 370 is set in its countdown mode and counts down once each 40 milliseconds in response to the aforementioned command pulse. In the preferred embodiment, this rate of count produces an integral control term at the output of the closed loop control circuit that varies in ramp fashion at a rate producing a trimming factor that effects a change of about 0.9 air/fuel ratio per second. Conversely, when the output of the comparator switch is at a logic 0 level, the up/down counter is set in its count-up mode and is clocked up once each 40 milliseconds to produce a ramp rate representing a change of about 0.9 air/fuel ratios per second.

A proportional term is also provided in the form of a step change in response to the output of the comparator switch 366. When the air/fuel ratio is rich, a constant value is subtracted from the integral term and when the air/fuel ratio is lean, a constant value is added to the integral term. In this manner, the proportional term in the form of a step change is provided in the closed loop trimming factor. The value of this step may be such that a step change of approximately 0.45 air/fuel ratios is provided when the air/fuel ratio passes through stoichiometry.

A closed loop controller having a gain producing the proportional step of about 0.45 air/fuel ratios and the integral term having the ramp rate of about 0.9 air/fuel ratios per second has been found to produce satisfactory results in operation with calibration learning. The particular desired gains may vary from system to system and may be varied in a system as a function of an operating parameter such as engine speed. However, in each system, the closed loop gains may be optimally selected based on an open loop calibration that does not substantially deviate from the desired calibration since errors which initially exist or subsequently occur in the open loop calibration will be trimmed out by the calibration learning control circuit 248.

To provide for the integral plus proportional term, a proportional reference generator 372 is provided which generates a constant which is one half the desired step change of the proportional term. This constant is coupled by means of a gate 374, which for purposes of the following discussion is assumed to be enabled, to the negative input of an adder 376 and to the positive input of an adder 378. The proportional term is added to the integral term output of the counter 370 by the adder 378 and subtracted from the integral term output of the up/down counter 370 by the adder 376. The output of either the adder 376 or 378 is selected as a function of the output of the comparator switch 366. In this respect, the output of the comparator switch 366 is coupled to the enable input of a gate 380 which, when the sensed air/fuel ratio is less than stoichiometry, enables the gate 380 to couple the output of the adder 376 to the input of a gated memory 382. The output of the comparator switch 366 is also coupled to the enable input of a gate 384 through an inverter 386 which is enabled to couple the output of the adder 378 to the gated memory 382 when the air/fuel ratio is greater than stoichiometry. The gated memory 382 samples and holds the output of either the gate 380 or the gate 384 in response to the command signal 33 each 10 milliseconds. In this manner, even though the up/down counter 370 is clocked only once each 40 milliseconds, the output of the comparator switch 366 is effectively sampled each 10 milliseconds with respect to the proportional term.

A reference count provided by a reference generator 388 is subtracted by an adder 390 from the value sampled by the gated memory 382. The value of the reference is equal to the magnitude of the integral plus proportional term representing a zero closed loop correction term. Therefore, the output of the adder 390 is zero representing a zero correction term when the proportional plus integral term equals the reference value.

While other values may be selected, the counter 370 may have the capacity to count from 0 to 256 and the reference number provided by the reference generator 388 is 127 so that a count of 127 in the counter 370 is representative of a zero correction value. As with the trimming factors stored in the look-up table 244, the closed loop adjustment value output of the adder 390 in the preferred embodiment is a signed number representing a percentage figure with 0 being 100%, a minus value being a percentage less than 100% and a plus value being a percentage greater than 100%. Each count in the counter 370 may represent a 0.25% change in the fuel flow rate.

The closed loop trimming factor at the output of the adder 390 is coupled to a multiplier 391 in FIG. 12 where it is multiplied with the open loop determined injection duration so as to obtain an injection duration which is corrected in a magnitude and direction tending to achieve a stoichiometric air/fuel ratio. When the output of the adder 390 is greater than 0, the injection duration is increased to effect an increase in the fuel flow and when the output is less than 0, the injection duration is decreased to effect a decrease in fuel flow. The injection duration output of the multiplier 391 is sampled and stored in a gated memory 392 in response to the command signal 34. This value is used by an injection pulse generator 393 (FIG. 9) in controlling the energization of the injectors 104 and 106.

The injection pulse generator 393 may take any known form for generating a timed injector energizing pulse from a digital number. For example, the generator 393 may include a count-down counter loaded with the digital number representing the determined injection duration by each pulse provided by the distributor 185 (FIG. 7) and counted down to zero by the clock pulses CLK1 with the energizing pulse being provided for the duration of the count-down period. The alternating of the injectors 104 and 106 may be provided by a flip-flop and logic gates alternately enabled by the flip-flop which may be triggered by the pulses provided by the distributor 185 (FIG. 7).

The reference level supplied to the comparator switch 366 by the adder 368 is equal to the sum of a constant value supplied by a reference generator 394 and a value supplied in response to the output voltage 02V2 of the oxygen sensor 186 downstream of the catalytic converter 170. The signal 02V2 from the gated memory 301 of FIG. 9 is compared with a reference level provided by a reference generator 395 by a comparator switch 396. The value of the reference number provided by the reference generator 395 is equal to the 02V2 level when the air/fuel ratio sensed by the oxygen sensor 186 is at stoichiometry. Consequently, the output of the comparator switch 196 is a logic 1 level when the air/fuel mixture is rich and is a logic 0 level when the air/fuel mixture is lean. This output controls the up/-down counting state of a two byte up/down counter 398 which is clocked by the command signal 35 each 10 milliseconds. The counter 398 is set in its down counting mode when the switch 396 output is high and in its up counting mode when the switch 396 output is low. The value of the high byte (which may be positive or negative) is added by the adder 368 to the reference value supplied by the reference generator 394 to provide the reference level for the comparator switch 366.

Each byte in the up/down counter 398 is comprised of eight bits so that the high byte changes value on each 256th count in an up or down direction. The time constant of the up/down counter 398, which functions as an integrator, is substantially slower than the time constant of the integrator formed by the up/down counter 370 which is clocked every 40 milliseconds. In this respect, the counter 398, in the preferred embodiment, can adjust the voltage level reference applied to the comparator switch 366 at a maximum rate that is equivalent to 6 millivolts per second as related to the output voltages of the sensors 184 and 186.

As previously indicated, during certain operating conditions of the vehicle engine 100, it is desired to operate at air/fuel ratios other than stoichiometry as determined by the air/fuel ratio schedule circuit 356 of FIG. 9. During this time period and also during the period that the sensor 184 is below its operating temperature, it is desired to disable the closed loop control circuit of FIG. 13 so that it does not respond to the air/fuel ratio variance from stoichiometry and does not respond to erroneous cold sensor signals. The air/fuel ratio schedule circuit 356 of FIG. 9 provides a disable signal DA each time that the scheduled air/fuel it provides varies from the value generally determined to provide a stoichiometric air/fuel ratio. The disable signal DA and an inverted form of the temperature signal 02T1 from an inverter 399 are supplied to the input of an inverter 400 through an OR gate 401 and function to disable the gate 374 when an air/fuel ratio other than stoichiometry is scheduled and when the sensor 184 is below its operating temperature. The output of the OR gate is also coupled to the enable input of a gate 402 which is enabled by the disable signal DA or the temperature signal 02T1 when the sensor 184 is cold to couple a stored number in a preset number generator 403 to the preset input of the up/down counter 370. The value of the preset number is made equal to the number generated by the reference generator 388 so that the integral plus proportional terms sampled by the gated memory 382 in response to the command signal 33 is equal to the reference value provided by the reference generator 388. Under these conditions, the output of the adder 390 is a zero value representing a zero trimming value for the injection pulse calculator circuit of FIG. 12. Consequently, the closed loop circuit is ineffective and the fuel controller 178 operates solely on an open loop basis.

As previously indicated, the up/down counter 370 is clocked each 40 milliseconds by a command signal provided by the sequential pulse generator 278 of FIG. 8. However, prior to the generation of this command signal, the sequential pulse generator 276 commands the calibration learning control circuit 248 to determine the transport delay through the engine 100 as a function of the engine operating parameters. The portion of the calibration learning control circuit which functions in response to the command pulses generated by the sequential pulse generator 276 to determine the transport time delay is illustrated in FIG. 15.

The transport delay through the engine 100, which was illustrated with reference to FIG. 4, includes one component which is a function of the engine speed and a second component which is a function of the manifold absolute pressure. The system of FIG. 15 determines the total transport delay by first calculating the delay associated with each of the parameters, engine speed and absolute manifold pressure, and then summing the two determined values to obtain the total transport delay. In another embodiment, however, the delay may be determined solely as a function of engine speed which accounts for the most significant portion of the total transport delay.

Figures 15, 16, 17, 19:
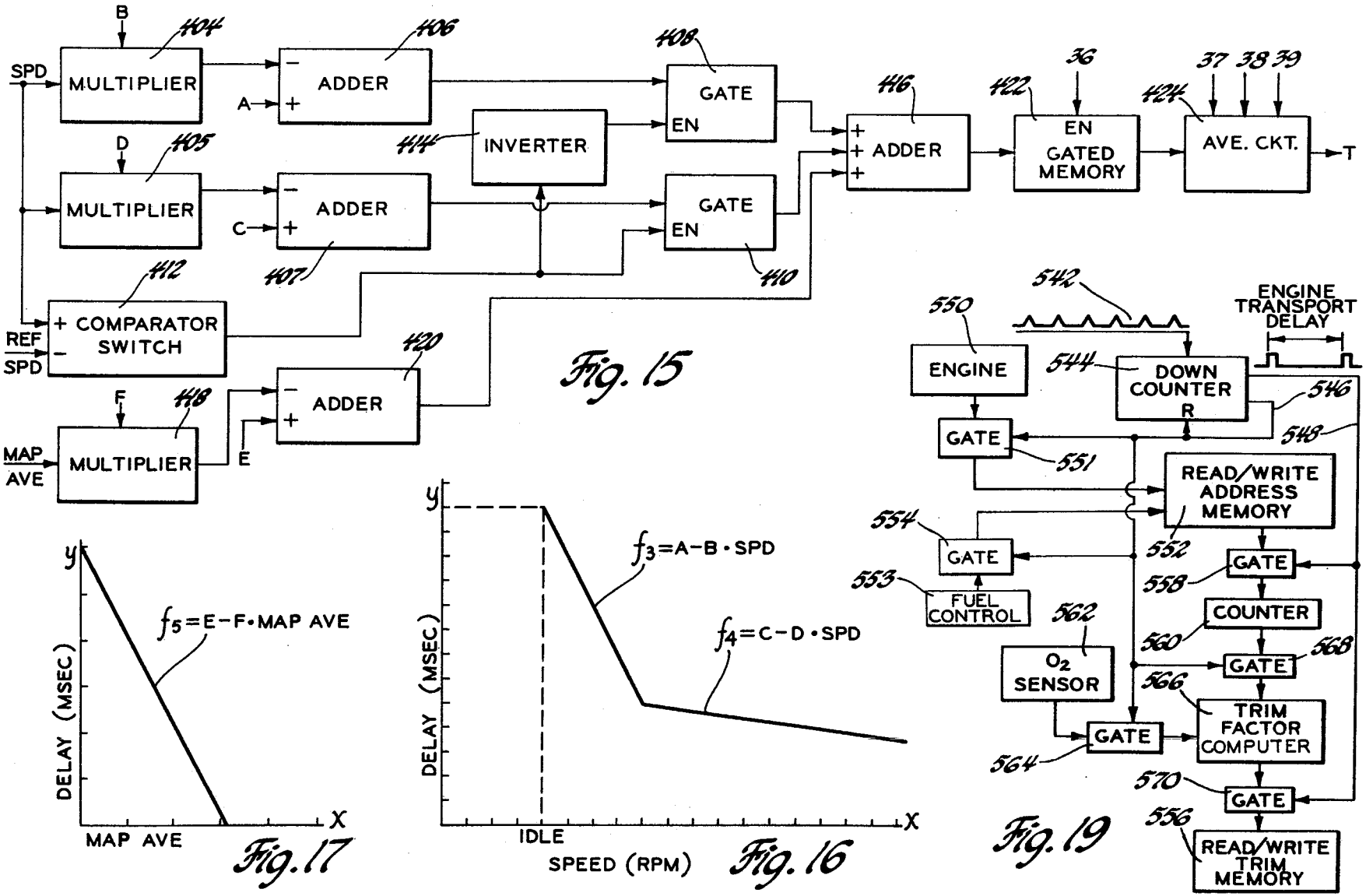
FIG. 15 is a block diagram of the system for determining the system transport time delay in a system of the type shown in FIG. 1.
FIG. 16 is a graph illustrating the component of the transport delay attributed to vehicle engine speed.
FIG. 17 is a graph illustrating the component of the transport delay attributed to manifold absolute pressure.
FIG. 19 is a block diagram illustrating a second embodiment of the invention.

The component of the total transport delay through the engine 100 which is a function of vehicle speed is represented by the curve of FIG. 16 and the component which is a function of manifold absolute pressure is represented by the curve of FIG. 17. The curves in FIGS. 16 and 17 are determined experimentally and while the determined functions are usually complex, they are generally accurately approximated as illustrated in the figures by straight line segments.

As seen in FIG. 16, the delay associated with engine speed is approximately by a two segment curve beginning at engine idle speed which is represented by the function $f_3 = A - B \cdot SPD$ over a first speed range and a function $f_4 = C - D \cdot SPD$ over a second speed range. The constants A and C are the y axis intercept values and the constants B and D are the slope values.

The transport delay associated with the manifold absolute pressure is represented by the single straight line segment having the function $f_5 = E - F \cdot MAPAVE$ where E is the y axis intercept and F is the slope.

Referring to FIG. 15, the engine speed from the output of the gated memory 328 of FIG. 9 is multiplied by the slope constant B by a multiplier 404 and multiplied by the slope constant D by a multiplier 405. The output of the multiplier 404 is subtracted from the intercept value A by an adder 406 whose output is a digital word representing the function $f_3$. The output of the multiplier 405 is subtracted from the intercept constant C by an adder 407 whose output represents the function $f_4$. The outputs of the adders 406 and 407 are coupled to respective inputs of gates 408 and 410 which are selectively controlled as a function of the speed range of the vehicle engine 100. In this respect, a comparator switch 412 compares the instantaneous engine speed with a reference speed signal equal to the engine speed at the intersection of the two straight line segments of FIG. 16. In one embodiment, this reference speed may be equal to 1200 rpm. When the engine speed is less than the reference speed, the output of the comparator switch 412 is a logic zero level which enables the AND gate 408 through an inverter 414 to couple the output of the adder 406 to an adder 416. Conversely, when the engine speed is greater than the reference speed, the gate 410 is enabled to couple the output of the adder 407 to the adder 416. The digital number coupled to the adder 416 from either the gate 408 or the gate 410 represents the component of the transport delay which is related to the speed of the engine 100.

The transport delay associated with the manifold absolute pressure is provided by a multiplier 418 which multiplies the manifold absolute pressure by the slope constant F and whose output is subtracted from the intercept constant E by an adder 420 whose output represents the transport delay associated with the manifold absolute pressure. This output is coupled to the adder 416 which provides an output representing the sum of the transport delays attributed to the engine speed and absolute manifold pressure and which represents the total transport delay. The delay is sampled and stored by a gated memory 422 in response to the command signal 36.

The preferred embodiment of the invention utilizes an average transport delay time T. This is accomplished by an averaging circuit 424 which takes the form of the averaging circuit described in FIG. 11 having, for example, the reference number 4 determining the averaging time constant and which provides an output average in response to the command signals 37, 38 and 39.

Following the routine determining the transport time delay, the sequential pulse generator 276 of FIG. 8 generates the command signal 40 which causes the gated memory 264 to sample the index number output of the counter 260. If the index number is less than four, in the preferred embodiment, the output of the comparator switch 266 remains a logic 0 and the next clock pulse CLK0 clocks the sequential pulse generator 276 which generates its final command signal 41 to reset the flip-flop 274. Thereafter, upon the occurrence of the next clock pulse CLK2, the flip-flop 274 is again set and the 10 millisecond cycle previously described relative to the command signals 1 through 41 is repeated. However, if the index number in the counter 260 is four, representing a lapsed time of 40 milliseconds, the sampling of its output by the gated memory 264 in response to the command signal 40 causes the comparator switch 266 to shift to a logic 1 level which disables the AND gate 270 and enables the AND gate 268 to provide clock pulses at the frequency of the clock signals CLK0 to the sequential pulse generator 278.

The first command signal 42 generated by the sequential pulse generator 278 resets the index number in the counter 260 to zero. The next command pulse 43 comprises the 40 msec. period clock pulse previously referred to for clocking the up/down counter 370 in the $O_2$ closed loop control circuit of FIG. 14.

Following the clocking of the integral controller in the $O_2$ closed loop control circuit, the sequential pulse generator 278 commands the calibration learning control circuit 248 to perform the calibration learning control routine.

Figure 18:
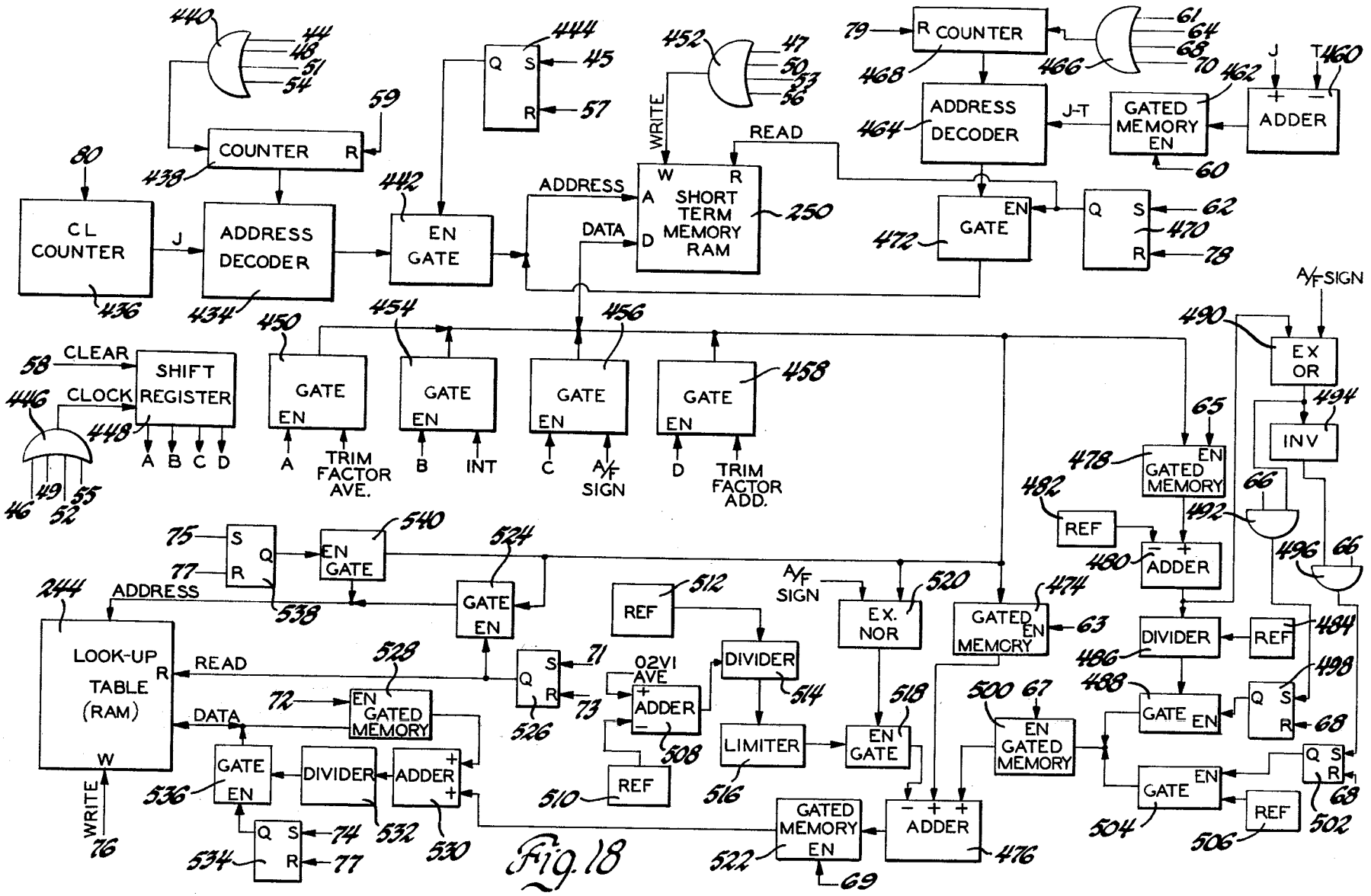
FIG. 18 is a block diagram of the calibration learning control for trimming the open loop calibration of the fuel control system of the type shown in FIG. 1.

Referring to FIG. 18, the calibration learning control circuit is first commanded by the sequential pulse generator 278 to memorize the current values of the engine operating parameters. These parameters are the address at the output of the address decoder 358 determined by existing values of engine speed and manifold absolute pressure, the average trimming term at the output of the averaging circuit 362, the sign of the air/fuel ratio error as represented by the two level output of the comparator switch 366 of FIG. 14 and the integral correction term output INT. of the counter 370 in the closed loop controller of FIG. 14. These parameters are stored at respective memory locations in the short term memory RAM 250 at addresses related to time.

The storing of the respective parameters is provided by means of an address decoder 434 which generates an address location in response to the count in a counter 436 representing time in 40 msec. increments and the output of a counter 438 representing the parameter being stored. This address is coupled to a circuit which writes the value of the parameter supplied thereto in the memory location in the RAM 250 corresponding to the address.

Assuming the counter 438 is reset, the current value of the average trimming factor used to trim fuel flow at time J (the current time) is stored in the short term memory RAM 250 as follows. The command pulse 44 is supplied to an OR gate 440 whose output clocks the counter 438. The resulting binary code represents a portion of the address in the RAM 250 corresponding to the current average trimming factor. This code in conjunction with the count in the counter 436 representing the current time J is decoded by the address decoder 434 which supplies the respective address to a gate 442. The command pulse 45 then sets a flip-flop 444 whose Q output shifts to a logic 1 level to enable the gate 442 to couple the address output of the decoder 434 to the address line inputs of the RAM 250.

The command pulse 46 is coupled to an OR gate 446 whose output clocks a four stage shift register 448 (similar to the sequential pulse generators 276 and 278 of FIG. 8) producing sequential outputs A through D. The A output of the register 448 shifts to a logic 1 level and enables a gate 450 to couple the signed word representing the current average trimming factor at the output of the averaging circuit 362 (FIG. 9) to the data lines of the RAM 250. The command pulse 47 is next applied to an OR gate 452 whose output is coupled to the write command input of the RAM 250 which is caused to write the signed word representing the current average trimming factor at the address location provided by the address decoder 434.

The command pulse 48 then clocks the counter 438 whose binary code represents the output count of the integrator 370 (FIG. 14). The output of the address decoder 434 is then the address location in the RAM 250 corresponding to the value of the integral term in the closed loop controller at time J. The command pulse 49 then clocks the shift register 448 whose A output returns to a logic 0 level and whose B output shifts to a logic 1 level to enable a gate 454 to couple the value of the integral term to the data lines of the RAM 250. Thereafter the command pulse 50 causes the RAM to write the current value of the integral term INT. at the address location provided by the decoder 434.

In like manner, the command pulses 51, 52 and 53 cause the sign of the air/fuel ratio error coupled to a gate 456 from the comparator switch 366 of FIG. 14 to be stored at the storage location in the short term memory RAM 250 corresponding to time J, and the command pulses 54, 55 and 56 cause the current trim factor address at the output of the address decoder 358 (FIG. 9) coupled to a gate 458 to be stored at the storage location in the RAM 250 corresponding to time J. Command signal 57 then resets the flip-flop 444 whose Q output shifts to a logic 0 state to decouple the decoder 434 from the RAM 250 and the command pulse 58 resets the register 448 so that all of its output lines are a logic 0 level. The command pulse 59 then resets the counter 438.

As will subsequently be described, the counter 436 will be clocked so that its count represents a time equal to J + 40 msec. Thereafter, upon the occurrence of the sequential command signals 44 through 59, the values of the engine operating parameters at time J + 40 msec. will be stored at corresponding time related addresses in the RAM 250. This sequence is repeated each 40 msec. so that the short term memory RAM 250 contains at sequential memory locations relating to time, a history of the values of the engine operating parameters. As previously indicated, the history represents the most recent values covering a time period at least greater than the maximum transport delay through the vehicle engine.

The sequential pulse generator 278 next commands the calibration learning control circuit to determine a new value of the trimming term in accordance with sensed errors in the air/fuel ratio. In order to correlate the current air/fuel ratio error sensed by the $O_2$ closed loop control circuit 246 and the engine operating parameters which caused the sensed error, the calibration learning control circuit of FIG. 18 first determines the address locations of the engine operating parameters in the short term memory RAM 250 which resulted in the sensed error. The time portion of these addresses is determined by an adder 460 which subtracts the calculated value of the transport time T (FIG. 15) from the current time J represented by the output code of the counter 436. The time J-T in the history of the engine operation is then used to determine the operating parameters which caused the current air/fuel ratio error.

The determined time J-T in the history of engine operation is caused to be stored in a gated memory 462 by the command signal 60. The output of the gated memory 462 is coupled to an input of an address decoder 464.

The calibration learning control circuit is then commanded to determine a new open loop trimming value. The proper open loop trimming value recalled from the look-up table 244 (FIG. 9) in response to a particular engine operating point is one which adjusts the output of the divider 357 (FIG. 12) so that without additional adjustment by the closed loop controller of FIG. 14, the desired air/fuel ratio results. In the preferred embodiment, the desired ratio is stoichiometry so that if the proper trimming value was used, the closed loop controller output which would result in the proper injection duration is zero, which corresponds to a count of 127, in one embodiment, at the output of the gated memory 382 (FIG. 14). Therefore, in the preferred embodiment, one component of the adjustment for the trimming value determined by the engine operating conditions at time J-T is a function of the value of the integral term output of the closed loop controller at the time J-T and has a sense tending to reduce the integral correction term to zero (127 counts in one embodiment). For example, if the integral term at time J-T is of a sense that increases the open loop determined fuel supply rate, an error can be attributed to the open loop calibration if after a transport delay time later (time J) the sensed air/fuel ratio is greater than stoichiometry (lean). Further, the open loop calibration error is at least equal to the integral correction term. Similarly, an error can be attributed to the open loop calibration if at time J-T the integral term is of a sense to decrease the fuel supply rate and at time J the sensed air/fuel is less than stoichiometry (rich). For the two aforementioned conditions, the integral correction value (or, as in the preferred embodiment, a portion thereof) at time J-T may be transferred to the trim factor used at time J-T so that when that trim factor is again recalled from memory, it will result in an open loop determined fuel flow rate that more nearly produces a stoichiometric air/fuel ratio.

Additionally, in the present embodiment, an adjustment to the trim factor used at time J-T is made if the sense of the air/fuel ratio error at the present time J is the same as the sense of the air/fuel ratio error at time J-T at which time the conditions which caused the present air/fuel ratio existed. This condition indicates that the total fuel flow correction provided by the trim factor and the closed loop controller was insufficient to reduce the air/fuel ratio error to zero. In the present embodiment, the magnitude of this adjustment is made dependent upon the average air/fuel ratio error as sensed by the sensor 184 (FIG. 1).

In accordance with the foregoing, a new value for the trimming factor associated with the engine conditions at time J-T is determined in accordance with the following expression:

$$\text{TRIM FACTOR AVE. at } J-T + \frac{\text{INT. at } J-T-k_1}{k_2} - \frac{02V1_{AVE}-k_3}{k_4}$$

wherein $k_1$ is a constant having the value of the integral term representing a zero integral term fuel adjustment which, in the present embodiment, is 127 counts, $k_2$ is a constant providing a deadband and which limits the trim factor adjustment to a portion of the integral term adjustment both of which provide for system stability, $k_3$ is a constant having the value of 02V1 at stoichiometry, and $k_4$ is a constant. In one embodiment, the values of $k_3$ and $k_4$ may be 8 and 4, respectively. Adjustment of the open loop trim factor in accordance with the closed loop integral term is made only if at time J-T the closed loop integrator is reducing the open loop determined fuel flow and at time J the air/fuel ratio is rich or if at time J-T the integrator is increasing the open loop determined fuel flow and at time J the air/fuel ratio is lean. Further, the adjustment of the open loop trim factor in accordance with the average air/fuel ratio is made only if the sense of the air/fuel ratio error at the present time J is the same as the sense of the error at time J-T.

The expression to determine a new trimming factor may take many other forms. For example, the trim term adjustment may include only the trim factor average and the integral term of the foregoing expression or may include only a constant added or subtracted from the trimming term at the look-up table 244 address determined by the operating conditions at time J-T. Additionally, if the system does not use a closed loop fuel adjustment, the trim factor used at time J-T may be adjusted based solely on the sign of the air/fuel ratio error at the present time J.

To implement the foregoing expression for adjusting the trim factor in the look-up table 244 at the address corresponding to the engine operating conditions existing at the time J-T so that when the vehicle engine again operates under those conditions the open loop fuel determination more closely produces a stoichiometric air/fuel ratio, the circuit of FIG. 18 is first commanded to recall the average trimming factor which was used at the time J-T from the short term memory RAM 250. The command pulse 61 is supplied to an OR gate 466 whose output clocks a previously reset counter 468. The address decoder 464 is responsive to the binary code output of the counter 468 and the output of the gated memory 462 representing the time J-T to provide the address location in the RAM 250 at which the average trim factor used at the time J-T was stored. The command pulse 62 then sets a flip-flop 470 whose Q output enables a gate 472 to couple the address output of the address decoder 464 to the address input lines of the short-term memory RAM 250. Additionally, the Q output of the flip-flop 470 is coupled to the read input of the RAM 250 which couples to its data lines the word stored at the address location corresponding to the address output of the decoder 464. This recalled word, which was the average trim factor at the time J-T, is thereafter stored in a gated memory 474 upon the provision of the command pulse 63. The output of the gated memory 474 representing the average trim factor used at time J-T is supplied to a positive input of an adder 476.

The circuit of FIG. 18 is then instructed to determine the adjustment to the recalled average trim factor in accordance with the integral term in the foregoing expression.

The command pulse 64 clocks the counter 468 whose binary code coupled to the address decoder 464 represents the portion of the address location in the short-term memory RAM 250 corresponding to the value of the integral term INT. of the closed loop fuel controller. The output of the address decoder 464 therefore is an address representing the location in the short term memory RAM 250 corresponding to the value of the integral term at time J-T. This address is coupled to the address input lines of the RAM 250 through the enabled gate 472. The RAM 250 then supplies the word representing the value of the integral term at time J-T to its data lines. The command signal 65 then causes the recalled value of the integral term to be stored in a gated memory 478.

The output of the gated memory 478 is coupled to the positive input of an adder 480 which subtracts from it the value $k_1$ provided by a reference generator 482. The value of the reference signal supplied by the reference generator 482 represents the value of the integral term producing a zero closed loop fuel correction to the open loop determined fuel flow rate. In the present embodiment, this value is a count of 127. The output of the adder 480 is a signed number which represents the amount of fuel added or subtracted by the integral correction term from the open loop determined fuel flow rate at time J-T. The output of the adder 480 relating to this integral correction term is divided by the constant $k_2$ provided by a reference generator 484 in a divider 486. The divider 486, which outputs only whole numbered values, represents one value of the adjustment to be made to the trim factor used at time J-T if the conditions previously set forth with respect to the integral adjustment term are met. This value is supplied to the input of a gate 488.

To determine whether the conditions exist for adjusting the average trimming term used at time J-T as a function of the value of the closed loop integral correction term, the signed bit output of the adder 480 representing whether the integral term at time J-T functioned to add or subtract fuel from the open loop determined fuel flow rate is applied to one input or an EXCLUSIVE OR gate 490 which also receives at a second input the signal output of the comparator switch 366 of FIG. 14 representing the current sense of the air/fuel ratio error. For purposes of illustration, it is assumed that the signed bit output of the adder 480 is a logic 1 level when the output of the adder 480 is positive representing the integral term adding fuel to the fuel flow rate and a logic 0 level when the output of the adder 480 is negative representing an integral term decreasing the fuel flow rate. The output of the EXCLUSIVE OR gate 490 is a logic 1 level when one or the other but not both of the inputs thereto is a logic 1 level. Consequently, the output of the EXCLUSIVE OR gate 490 is a logic 1 level only when if at time J-T the integral term functioned to add fuel to the fuel flow rate and at time J the sensed air/fuel ratio is lean or if at time J-T the integral term functioned to decrease the fuel flow rate and at time J the sensed/air fuel ratio is rich. Consequently, the output of the EXCLUSIVE OR gate 490 is a logic 1 level when the conditions exist for adjusting the trim term as a function as the value of the integral term at J-T and a logic 0 level when the conditions exist at which an error in the open loop calibration cannot be ascertained.

The output of the EXCLUSIVE OR gate 490 is coupled to one input of an AND gate 492 and to an inverter 494 whose output is coupled to one input of an AND gate 496. The command pulse 66 is coupled to the second input of each of the AND gates 492 and 496. When the conditions exist so that an adjustment can be made to the trim factor as a function of the value of the integral term INT., the output of the AND gate 492 upon the provision of the command pulse 66 functions to set a flip-flop 498 whose Q output enables the gate 488 to couple the output of the divider 486 representing the value of the integral correction to a gated memory 500. Conversely, if the conditions exist such that an adjustment of the trim term cannot be made as a function of the value of the integral term at time J-T, the output of the AND gate 496 functions to set a flip-flop 502 whose output enables a gate 504 to couple the output of a reference generator 506 representing zero to the input of the gated memory 500.

The command signal 67 causes the gated memory 500 to store either the value of the integral term adjustment provided by the divider 486 or zero, depending upon whether or not the circuit described determines if the conditions exist such that a correction can be made as a function of the value of the integral term that existed at time J-T. Thereafter, the command signal 68 functions to reset the previously set flip-flop 498 or 502.

The output of the gated memory 500 is supplied to a second positive input of the adder 476 which adjusts the value of the average trim factor used in the open loop determination of fuel flow at time J-T in accordance with the value of the integral term existing at the time J-T.

An adder 508 subtracts the constant value $k_3$ provided by a reference generator 510 from the average 02V1 value provided by the averaging circuit 308 of FIG. 9. The output of the adder 508, representing an average sensed deviation of the air/fuel ratio from the stoichiometric air/fuel ratio, is divided by the constant $k_4$ provided by a reference generator 512 in a divider 514. The output of the divider 514 is coupled to a limiting circuit 516 which limits the magnitude of the output of the divider 514. For example, in the preferred embodiment, the limiter 516 limits the output of the divider 514 to a maximum magnitude of 2. The output of the limiter 516 is coupled to the input of a gate 518. As previously indicated, in the present embodiment the output of the divider 514 as limited by the limiter 516 is only utilized if the sign of the air/fuel ratio error relative to stoichiometry has not changed over a time period equal to the determined transport delay T of the engine 100. This condition is determined by means of an EXCLUSIVE NOR GATE 520, which compares the sign of the air/fuel ratio error relative to stoichiometry at the current time J as represented by the output of the comparator switch 366 of FIG. 14, with the sign of the air/fuel ratio error at time J-T, which sign is recalled from the short term memory RAM 250.

The sign of the air/fuel ratio error at time J-T is recalled upon the generation of the command signal 68 which clocks the counter 468 whose output represents the portion of the address location in the RAM 250 corresponding to the sign of the air/fuel ratio error. The output of the address decoder 464 then represents the address location at which the sign of the $O_2$ error at time J-T is stored. This address is coupled to the address input lines of the RAM 250 whose data lines provide the sign of the $O_2$ error at the time J-T. The EXCLUSIVE NOR gate 250 provides a logic 1 output if the signs of the air/fuel ratio error are the same. This logic 1 output enables the gate 518 to couple the signed output of the limiter 516 to a negative input of the adder 476 which effects an adjustment of the average trim value used in the open loop determination of fuel flow at time J-T. The resulting adjusted trim factor applicable for the engine operating conditions that existed at time J-T is stored in a gated memory 522 upon the provision of the command pulse 69.

The new trimming factor to be stored in the look-up table 244 at the address corresponding to the engine operating conditions existing at time J-T is, in the preferred embodiment, an average of the newly calculated trim factor present at the output of the gated memory 522 and the current trim factor stored at the address location in the RAM determined by the conditions existing at time J-T. This averaging is provided since the engine may operate at the same operating conditions more than once during the period of a transport delay. Under these conditions the second determination of a new trim factor would not be based upon a sensed air/fuel ratio error resulting from the previously determined trim factor at those operating conditions. Therefore, the independently determined trim factors are averaged.

The aforementioned averaging is provided in FIG. 18 by first recalling the address of the look-up table 244 determined by the engine operating conditions existing at time J-T. The command pulse 70 clocks the counter 468 whose output is decoded, in conjunction with the output of the gated memory 462 representing the time J-T, by the address decoder 464 to provide the address of the memory location in the short term memory RAM 250 at which the trim factor address used at the time J-T is stored. The trim factor address at that memory location is provided at the data lines of the RAM 250. This address is coupled to the address inputs of the look-up table 244 by a gate 524 which is enabled by the Q output of a flip-flop 526 upon the provision of the command signal 71 which sets the flip-flop 526. Additionally, the Q output of the flip-flop 526 is coupled to the READ input of the look-up table 244 which provides at its data lines the trim factor presently stored at the address location determined by the engine operating conditions at the time J-T. This trim factor is stored in a gated memory 528 by the command signal 72. Thereafter, the command signal 73 resets the flip-flop 526 to decouple the address corresponding to the engine operating conditions at time J-T from the address lines of the look-up table 244.

The output of the gated memory 528 is supplied to the positive input of an adder 530 which also receives at a second positive input the output of the gated memory 522 representing the newly determined trim factor for the engine operating conditions which existed at time J-T. The sum of the two values are divided by 2 in a divider 532 whose output represents the new trim factor for the engine operating conditions existing at time J-T and which varies from the original trim factor stored in the look-up table 244 at the address location determined by the engine conditions at J-T in amount and sense so as to reduce the error in the open loop determination of fuel flow at that engine operating point. This newly determined trim factor is stored in the look-up table 244 at the location addressed by the engine operating conditions that existed at time J-T by the command pulses 74, 75 and 76. The command pulse 74 functions to set a flip-flop 534 whose output enables a gate 536 to couple the newly calculated trim factor to the data lines of the RAM 244. The command pulse 75 sets a flip-flop 538 whose Q output enables a gate 540 to couple the address of the look-up table 244 determined by the engine operating conditions existing at time J-T and which is provided at the data output lines of the short term memory RAM 250 to the address input lines of the look-up table 244. The command pulse 76 thereafter is supplied to the write input of the look-up table 244 which writes the newly calculated trim factor at the address determined by the previously existing engine operating conditions at time J-T. Thereafter, the command pulse 77 resets the flip-flops 534 and 538, the command pulse 78 resets the flip-flop 470, and the command pulse 79 resets the counter 468 so that the calibration learning control system illustrated in FIG. 8 is again placed in condition to recall the parameters from the short term memory RAM 250 during the next sequence provided by the sequential pulse generator 278 of FIG. 8. The command pulse 80 is thereafter generated which is coupled to the clock input of the counter 436 which is incremented by one count so that its count represents the time J + 40 msec.

The authority of the calibration learning and consequently the limit of the open loop trim factors in the table 244 may be limited by providing limiters at the output of the divider 532. The authority or limit in the magnitude of the trim factor correction is generally selected so as to be able to correct for anticipated initial and subsequently developed open loop calibration errors. In addition to providing a form of failsafe operation, the limiting of the calibration learning in the mixture leaning direction provides an alternative solution to the system response to the purge of a fuel vapor trap. The maximum leaning trim factor may be made small enough so that the calibration learning during the period of a vapor trap purge does not seriously effect engine performance or exhaust gas emission characteristics. Typically, the authority limits to achieve the foregoing may be 5% in the mixture leaning direction and 10% in the mixture enrichment direction.

In the foregoing manner, the calibrated learning control circuit of FIG. 18 is responsive to sensed errors in the air/fuel ratio and determines a new trimming factor for the location in the look-up table 244 which corresponds to the engine operating conditions that caused the sensed errors. Thereafter, when the engine 100 again returns to the same operating conditions, the new trimming factor results in an open loop determination of injection duration which more closely produces a stoichiometric air/fuel ratio. The trimming factors in the look-up table 244 are continually updated during engine operation so that open loop calibration errors from any source in the fuel controller are continually reduced on a dynamic basis. In this respect, even without the use of a closed loop adjustment, the system operates substantially as a closed loop with respect to the exhaust gases.

However, when the calibration learning control circuit reduces the calibration error over a period of time, such as in the embodiment described, a temporary air/fuel ratio offset from stoichiometry may result since a finite time determined by the system parameters is required to reduce the open loop calibration error to zero. For example, if an error exists in the open loop calibration at a particular engine operating point, a full adjustment of the trim factor corresponding to the particular engine operating point in accordance with a sensed error is not made during each calibration learning event. The amount of change made to the trimming factor is determined by the system parameters. Therefore the calibration error related to a particular engine operating point is reduced toward zero in response to repeated operation of the engine at the particular engine operating point with the time (represented by the number of calibration learning intervals at which the engine operates at the particular operating point whether consecutive or not) required to reduce the calibration error to zero being determined by the system parameters. When the calibration learning control circuit is used with a closed loop controller, this air/fuel ratio offset is corrected by the closed loop controller thereby improving the exhaust emission characteristics.

Following the command signal 80, the command signal 81 is generated which enables the gated memory 264 of FIG. 8 to sample the output of the counter 260. Since the index number from the counter 260 was previously set to zero by the command signal 42, the output of the comparator switch 266 disables the AND gate 268. The AND gate 270 then functions to clock the sequential pulse generator 276 upon the occurrence of the next clock pulse CLK0. The resulting generated command 41 is coupled to the reset input of the flip-flop 274 which is reset to disable the AND date 270. Upon the generation of the next clock pulse CLK2, the fuel controller is again commanded to perform its various routines in the manner and sequence previously described.

There are many possible embodiments contemplated of the invention described. For example, the order of the functions may vary widely from the order described, such as, the learning control routine may be prior to the closed loop routine or the closed loop controller may operate asynchronously with the learning control routine by using command signals generated independently from the system clock. In addition, the equations and methods of determining certain parameters may vary. For example, while the determination of the transport delay time T by the use of the current measurements of engine speed and manifold absolute pressure was described, the invention contemplates the determination of the transport delay time continuously as a function of the engine operating parameters existing over the period of the delay time or as a function of engine speed only.

A simplified embodiment of the invention is shown in diagrammatic form in FIG. 19. In this embodiment, pulse signal 542, which may be provided by a speed sensor such as 179, FIG. 6, has one or a small number of pulses per crankshaft revolution. These pulses are applied to a count-down counter 544 which resets at a time approximating the engine transport time delay. For example, if the transport time delay is about one second at a 600 rpm engine speed, the counter 544 may count down in about 10 crankshaft revolutions. A 64 stage counter 544 and six pulses per engine crankshaft revolution in signal 542 would, for example, provide a count down in approximately 10 crankshaft revolutions and a one second counting time at 600 rpm. At higher speeds, such as 2400 rpm., the counting time is reduced in inverse proportion to engine speed, but the engine transport time delay is also less, so that in an approximate way the counter 544 counts down in the engine transport time delay period.

The counter 544 has two outputs. One output is the reset output 546 which, among other functions, is energized at the completion of the count (zero count) and resets the counter, i.e., to 64, to count again. The second is a low count, such as two or four, in relation to the counter start, indicated at 548. This serves to transfer numbers between the system components as described below.

The engine 550 has sensors, such as manifold air pressure and engine speed, which deliver signal outputs which are fed through a gate 551 to the read/write intake address memory 552. The engine fuel controller 553 provides an output representing the current fuel trimming factor which is fed through a gate 554 to the memory 552. Gates 551 and 554 are enabled at the time of each reset pulse on line 546 and, when activated, transfer to the read/write address memory, the address of the then-instantaneous engine operating conditions and trimming factor. These numbers include, for example, the engine speed and manifold absolute pressure numbers, which define the address of the trim factor recorded on read/write trim memory 556. Gate 558 is enabled by the delayed pulse 548 of counter 544 to transfer the numbers recorded on memory 552 to a counter 560, thus freeing the memory 552 to receive a new set of numbers from engine 550 and fuel controller 553 when the next reset pulse occurs on line 546. At the time of the next reset pulse on line 546, the gate 564 is enabled to apply the signal from the $O_2$ sensor 562 located in the exhaust passage to the trim factor computer 566. The gate 568 is simultaneously enabled by the pulse on line 546 so that the address information for the trim factor, the trim factor and the sensor 562 output are available at the trim factor computer 566. On the next pulse on line 548, the address information and the computed proper trim factor are transferred to the read/write trim memory 556 by a gate 570 so as to update the recorded trim value at the proper address. The updated trim value is thus made available for recall in accordance with the address when the engine next operates at the engine conditions defined by such address.

The system of FIG. 19 lends itself to a high degree of simplification. For example, the trim factor computation in the computer 566 may be a number having only a positive or negative value determined only by the sense (plus or minus condition) of the sensor 562. The resulting number recorded in the trim factor computer 566 may be transferred without change to the read/write trim memory 556, along with the necessary address information, and added to or subtracted from the trim factor previously recorded at that address. Over a period of time, with this arrangement, the trim factors are step by step updated to provide learning control.

The foregoing simplified arrangement does not provide the degree of control achievable with the arrangement depicted in FIGS. 1–18. We believe, however, that under at least some circumstances it may provide sufficiently precise learning to achieve effective engine operation.

In the foregoing description, the fuel flow control system operates from the previously recorded calibration learning. Such system may be of any suitable type such as a carburetor, port fuel injection, throttle body fuel introduction as illustrated in FIG. 2, or otherwise. The metering may be accomplished in any suitable way, such as mass-flow conventionally used with carburetors or the speed-density metering conventionally used with fuel injection. As described above in connection with FIGS. 1–18, the system of FIG. 19 may also include some conventional closed loop control.

In the foregoing description of the embodiments described in FIGS. 1–18 and FIG. 19, the look-up table or read/write trim memory has been described as having the trim values recorded at the various addresses which it defines. If desired, the entire fuel control information may be recorded at such address. In this event, the required memory capacity is somewhat increased, but the total fuel supply information for each address can be withdrawn from the memory and applied to the fuel metering components without further computation. For example, the learning system of FIG. 19 may be used in the following manner. First, the engine may be constructed and the full fuel metering condition for each address (e.g., speed and manifold air pressure) recorded on the read/write trim memory 556. Then the engine can be operated with the system of FIG. 19 activated as above described, with an update of the fuel metering condition at each address of the memory 514 (now serving as a memory of total fuel supply information) occurring from time to time in accordance with the engine operating conditions. While no single update is likely to provide the full proper calibration with this system, it can be expected that over a period of time, the information will progressively approach the optimum and provide effective engine fuel control.

It is understood that other means may be employed in carrying out the invention. For example, the invention contemplates the use of a central processing unit, one or more random access memories and a program memory which instructs various input-output circuits and the central processing unit to perform the functions which were performed in the embodiment described.

Many equivalent embodiments will occur to those skilled in the art. The invention is therefore limited only by the claims which follow:

The embodiments of the invention in which an exclusive property or privilege is claimed are defined as follows:

1. A fuel control system for an internal combustion engine having combustion space into which an air/fuel mixture is supplied to undergo combustion and having means defining an exhaust gas passage from the combustion space into which spent combustion gases are discharged and are directed to the atmosphere comprising, in combination:

a sensor responsive to the oxidizing/reducing conditions at a predetermined point in the exhaust passage, and hence, after a transport time delay period dependent upon engine operating conditions, to the mixture supplied to the combustion space, the sensor having an output condition indicative of predetermined desired oxidizing/reducing conditions;

a memory having locations addressable in accordance with at least one engine operating condition and having a number at each such location determinative of a fuel supply rate as determined by the engine operating condition so as to produce the predetermined desired oxidizing/reducing conditions;

means effective to supply fuel to the combustion space at a rate determined at least by the number recalled from the memory at the location of the current value of the predetermined engine operating condition;

sampling means effective to sample and store at recurrent intervals at least the predetermined engine operating condition; and means responsive to at least the engine operating condition stored by the sampling means at the beginning of a particular transport time delay period and to the output condition of the sensor at the end of the particular transport time delay period effective to store in the memory at the address according to the engine operating condition at the beginning of the particular transport time delay period a new number having a value differing from the value previously stored at such address in a sense tending to restore the sensor output to the desired output condition.

2. A fuel control system for an internal combustion engine having combustion space into which an air/fuel mixture is supplied to undergo combustion and having means defining an exhaust gas passage from the combustion space into which spent combustion gases are discharged and are directed to the atmosphere comprising, in combination:

a sensor responsive to the oxidizing/reducing conditions at a predetermined point in the exhaust passage, and hence, after a transport time delay period dependent substantially upon engine speed, to the mixxture supplied to the combustion space, the sensor having an output condition indicative of predetermined desired oxidizing/reducing conditions;

a memory having locations addressable in accordance with at least one engine operating condition and having a number at each such location determinative of a fuel supply rate as determined by the engine operating condition so as to produce the predetermined desired oxidizing/reducing conditions;

means effective to supply fuel to the combustion space at a rate determined at least by the number recalled from the memory at the location of the current value of the predetermined engine operating condition;

sampling means effective to sample and store at recurrent intervals at least the predetermined engine operating condition;

means effective to determine the transport time delay period, said last mentioned means including an engine speed sensor effective to generate an engine speed signal and means responsive to the engine speed signal effective to provide an output signal that substantially represents the engine transport delay; and means responsive to at least the engine operating condition stored by the sampling means at the beginning of the determined transport time delay period and to the output condition of the sensor at the end of the determined transport time delay period effective to store in the memory at the address according to the engine operating condition at the beginning of the determined transport time delay period a new number having a value differing from the value previously stored at such address in a sense tending to restore the sensor output to the desired output condition.

3. In combination, an internal combustion motor vehicle engine effective to propel a vehicle at operator controllable speeds and accelerations and being of the type wherein fuel is supplied at an intake point to energize the engine and spent exhaust gases are discharged at a predetermined discharge point;

a three-way catalytic converter effective to treat the exhaust gases downstream of said discharge point;

means effective in response to the current value of at least one engine operating condition to supply fuel to said intake point;

trimming means including a read/write memory addressable in accordance with an engine operating parameter effective to trim the fuel supplied by said first means in accordance with a number recalled from said memory at the address of the current value of the engine operating parameter;

short term memory means recurrently effective to store the value of at least said operating parameter;

a sensor system responsive to a condition of the exhaust gases indicative of the three-way convertibility of the exhaust gases at the converter;

means responsive to at least one engine variable effective to compute an approximation of engine transport delay;

elements responsive to the short term memory, the sensor system and said last means effective to determine at least the sense of the deviation from three-way convertibility of said exhaust gases at a time delayed by the time determined by said last means from the time of storing the operating parameter on the short term memory; and means effective to write on the read/write memory an adjustment of the prior number in accordance with at least the sense of the value determined by said elements.

4. A fuel control system for a motor vehicle internal combustion engine having an intake chamber from which an air/fuel mixture is drawn into a combustion space to undergo combustion and having means defining an exhaust gas passage from the combustion space into which the spent combustion gases are discharged and directed to the atmosphere, the system comprising:

means effective to recurrently generate a fuel control signal from the values of predetermined engine operating parameters and trim the fuel control signal by a trimming factor recalled from storage at an address location determined by the engine operating parameters;

fuel supply means effective to supply fuel to the intake chamber in accordance with at least the trimmed fuel signal;

sampling means effective to recurrently store at least the values of the engine operating parameters to form a history of operation of the engine;

sensor means effective to recurrently sense the condition of the exhaust gases at the discharge point in relation to a predetermined desired condition of the gases;

means effective to determine the transport time delay T between the intake point and the predetermined discharge point, the transport time delay T being equal to the sum of a first delay component that is inversely proportional to the absolute pressure in the intake chamber and a second delay component that is inversely proportional to the engine speed;

means effective to recurrently recall the values of the engine operating parameters stored at time J-T, where J is the time at which the most recent condition of the exhaust gases is sensed by the sensor means; and means responsive to the sensed condition of the exhaust gases at time J and the values of the recalled engine operating parameters effective to determine and store a new trimming factor at the storage address location determined by the recalled engine operating parameters having a value differing from the trimming factor previously stored at such address in a sense such as to tend to restore the sensor output to the predetermined desired condition.

5. A fuel control system for a motor vehicle internal combustion engine having an intake chamber from which an air/fuel mixture is drawn into a combustion space to undergo combustion and having means defining an exhaust gas passage from the combustion space into which the spent combustion gases are discharged and directed to the atmosphere, the system comprising:

means effective to recurrently generate a fuel control signal from the values of predetermined engine operating parameters adjusted by a trimming factor recalled from storage at an address location determined by the engine operating parameters;

fuel supply means effective to supply fuel to the intake chamber in accordance with at least the adjusted fuel control signal;

sampling means effective to recurrently store at least the values of the engine operating parameters at intervals substantially less than the smallest operating transport time delay between the intake point and the discharge point to provide a history of operation of the engine, the sampling means having at least a number of storage locations equal to the greatest operating transport delay divided by the sampling interval;

sensor means effective to recurrently sense once during each of the intervals the condition of the exhaust gases at the discharge point in relation to a predetermined desired condition of the gases;

means responsive to at least the value of engine speed effective once during each of the intervals to determine the value T of the transport time delay;

means effective once during each of the intervals to recurrently recall the values of the engine operating parameters stored at time J-T where J is the time of the last interval; and means responsive to the sensed condition of the exhaust gases at time J and the values of the recalled engine opearating parameters effective to determine and store a new trimming factor at the storage address location determined by the recalled engine operating parameters, the new trimming factor having a value differing from the trimming factor previously stored at such address in a sense such as to tend to restore the sensor output to the predetermined desired condition.

6. In a method of operating a motor vehicle internal combustion engine having a catalytic converter, the steps of (a) substantially continuously determining the fuel rate primarily on an open loop basis from engine operating conditions and a trimming value stored in memory at one address associated with said conditions, (b) applying fuel at such rate substantially continuously, (c) periodically sampling the oxidizing/reducing conditions at the catalytic converter, (d) determining from such sampling and at least one engine operating condition earlier in time by substantially the engine transport delay the change in the trimming value required to more nearly provide the desired oxidizing/reducing conditions and (e) storing a new trimming value at the address of the earlier engine operating conditions that gave rise to the sampled oxidizing/reducing conditions so as to make the engine operation more nearly that desired.

7. The process of operating an internal combustion engine in a motor vehicle, the engine being effective to propel the vehicle at operator controllable speeds and acceleration and being of the type wherein fuel is supplied at an intake point to energize the engine and spent exhaust gases are discharged at a predetermined discharge point, comprising the steps of:

determining the fuel requirements of the engine in response to certain fuel determining engine operating parameters, adjusted by a trimming factor separate from said parameters and recalled from storage at an address location determined by at least one of said parameters;

supplying fuel to the engine in accordance with at least said predetermined fuel requirements;

recurrently storing at least the values of said operating parameters;

recurrently sensing the condition of the exhaust gases at said discharge point in relation to a predetermined condition of said gases;

determining from at least the value of engine speed the value T of the transport time delay between said intake point and said predetermined discharge point;

recurrently recalling the values of said operating parameters that were stored at the time T prior to the last sensed exhaust gas condition;

determining at least the sense of change in the trimming factor determined by each of said recalled values that is required to shift the amount of fuel supply in a direction to provide the predetermined condition of the exhaust gases at said discharge point; and storing a new trimming factor at the address determined by each of the recalled values of said operating parameters that is shifted in said direction in relation to the previously stored value.

8. The process of operating an internal combustion engine, the engine being of the type wherein fuel is supplied at an intake point to energize the engine and spent exhaust gases are discharged at a predetermined discharge point, comprising the steps of:

scheduling a desired air/fuel ratio in response to predetermined engine operating conditions to provide desired engine operation;

determining from predetermined engine operating parameters the engine fuel requirement resulting in a predetermined air/fuel ratio determined to produce a predetermined exhaust gas condition, trimmed by a trimming factor separate from said parameters and recalled from storage at an address location determined by at least one of said parameters;

adjusting the trimmed engine fuel requirement in accordance with the scheduled air/fuel ratio;

supplying fuel to the engine in accordance with at least the adjusted engine fuel requirement;

recurrently storing at least the value of the address location determining engine operating parameters;

sensing the condition of the exhaust gases at said discharge point in relation to the predetermined condition of said gases;

determining the value of the transport delay time between the intake point and the predetermined discharge point;

recurrently recalling the values of the operating parameters that were stored at the determined transport delay time prior to the last sensed exhaust gas condition;

adjusting the stored trimming factor determined by each of the recalled values in response to the deviation of the sensed condition of the exhaust gases from the predetermined exhaust gas condition in a direction to provide an open loop determined engine fuel requirement that more closely results in the predetermined exhaust gas condition; and inhibiting the step of adjusting the stored trimming factor when the scheduled air/fuel ratio deviates from the predetermined air/fuel ratio determined to produce the predetermined exhaust gas condition.

9. A fuel control system for a motor vehicle internal combustion engine having an intake chamber from which an air/fuel mixture is drawn into a combustion space to undergo combustion and having means defining an exhaust gas passage from the combustion space into which the spent combustion gases are discharged and directed to the atmosphere, the system comprising:

a three-way catalytic converter effective to treat the exhaust gases downstream of the discharge point, the converter having convering characteristics that are a function of the oxidizing/reducing conditions in the exhaust passage;

a sensor responsive to the oxidizing/reducing conditions at a predetermined point in the exhaust passage, and hence, after a transport time delay period dependent upon engine operating conditions, to the mixture supplied to the combustion space, the sensor producing a signal indicative of the oxidizing/reducing conditions of the exhaust gases;

means effective to recurrently generate a fuel control signal from the values of at least one predetermined engine operating parameter and trim the fuel control signal by a trimming factor recalled from storage at an address location determined by the engine operating parameter;

a closed loop circuit responsive to the sensor signal effective to adjust the trimmed fuel control signal in a direction tending to restore a predetermined oxidizing/reducing condition at which the converter has desired converting characteristics when the sensor signal represents a deviation of the exhaust gas oxidizing/reducing condition from the predetermined oxidizing/reducing condition;

fuel supply means effective to supply fuel to the intake chamber in accord with the closed loop adjusted trimmed fuel signal;

sampling means effective to sample and store at recurrent intervals at least the predetermined engine operating parameter and the valve of the closed loop fuel adjustment; and means responsive to at least the engine operating parameter and the value of the closed loop adjustment stored by the sampling means at the beginning of a particular transport time delay period and at least the oxidizing/reducing condition represented by the sensor signal at the end of the particular transport time delay period effective to store at the storage address location determined by the engine operating parameter at the beginning of the particular transport time delay period a new number having a value differing from the value previously stored at such address location in a sense tending to restore the desired oxidizing/reducing condition.

10. A fuel control system for a motor vehicle internal combustion engine having an intake chamber from which an air/fuel mixture is drawn into a combustion space to undergo combustion and having means defining an exhaust gas passage from the combustion space into which the spent combustion gases are discharged and directed to the atmosphere, the system comprising:

a three-way catalytic converter effective to treat the exhaust gases downstream of the discharge point, the converter having converting characteristics that are a function of the oxidizing/reducing conditions in the exhaust passage;

a sensor responsive to the oxidizing/reducing conditions at a predetermined point in the exhaust passage, and hence, after a transport time delay period dependent upon engine operating conditions, to the mixture supplied to the combustion space, the sensor producing a signal indicative of the oxidizing/reducing conditions of the exhaust gases;

means effective to recurrently generate a fuel control signal from the values of at least one predetermined engine operating parameter and trim the fuel control signal by a trimming factor recalled from storage at an adress location determined by the value of the engine operating parameter;

a closed loop circuit responsive to the sensor signal effective to generate a closed loop signal for adjusting the trimmed fuel control signal in a direction tending to restore a predetermined oxidizing/reducing condition at which the converter has desired converting characteristics when the sensor signal represents a deviation of the exhaust gas oxidizing/reducing condition from the predetermined oxidizing/reducing condition, the closed loop signal including an integral term varying at a rate effecting an adjustment of about 0.9 air/fuel ratios per second in the trimmed fuel control signal;

fuel supply means effective to supply fuel to the intake chamber in accord with the closed loop adjusted trimmed fuel signal;

sampling means effective to sample and store at recurrent intervals at least the predetermined engine operating parameter and the value of the closed loop fuel adjustment; and calibration learning means responsive to at least the engine operating parameter and the value of the closed loop adjustment stored by the sampling means at the beginning of a particular transport time delay period and at least the oxidizing/reducing condition represented by the sensor signal at the end of the particular transport time delay period effective to store at the storage address location determined by the engine operating parameter at the beginning of the particular transport time delay period a new number having a value differing from the value previously stored at such address location in a sense tending to restore the desired oxidizing/reducing condition and by an amount less than the amount required to restore the desired oxidizing/reducing condition determined by system parameters, the number at a particular address determined by a particular value of the engine operating parameter having a value approaching the value which produces the desired oxidizing/reducing condition in response to recurrent operation of the engine at the particular value of the operating parameter, whereby the closed loop circuit and the calibration learning means cooperate to achieve the desired oxidizing/reducing condition for all engine operating conditions.

11. A fuel control system for an internal combustion engine having combustion space into which an air/fuel mixture is supplied to undergo combustion and having means defining an exhaust gas passage from the combustion space into which spent combustion gases are discharged and are directed to the atmosphere; comprising, in combination:

a sensor responsive to the oxidizing/reducing conditions at a predetermined point in the exhaust passage, and hence, after a transport time delay period dependent substantially upon engine speed, to the mixture supplied to the combustion space, the sensor having an output condition indicative of predetermined desired oxidizing/reducing conditions;

a memory having locations addressable in accordance with at least one engine operating condition and having a number at each such location determinative of a fuel supply rate as determined by the engine operating condition so as to produce the predetermined desired oxidizing/reducing conditions;

means effective to supply fuel to the combustion space at a rate determined at least by the number recalled from the memory at the location of the current value of the predetermined engine operating condition;

an engine speed sensor producing speed pulses at a frequency related to engine speed;

a counter effectively to recurrently count a predetermined number of speed pulses, the predetermined number having a value such that the time period during which the speed sensor produces the predetermined number of pulses generally equals the engine transport time delay;

means responsive to the count in the counter effective at substantially the beginning of the count to store at least the predetermined engine operating condition;

means responsive to the count in the counter effective at substantially the end of the count to sample the output condition of the sensor; and means responsive to at least the engine operating condition stored at the beginning of the count and to the output condition of the sensor at the end of the count effective to store in the memory at the address according to the engine operating condition at the beginning of the count a new number having a value differing from the value previously stored at such address in a sense tending to restore the sensor output to the desired output condition.

12. In a method of operating a motor vehicle internal combustion engine having a catalytic converter, the steps of (a) substantially continuously determining the fuel rate primarily on an open loop basis from engine operating conditions and a trimming value stored in memory at one address associated with said conditions, (b) adjusting at a predetermined rate the open loop determined fuel rate in response to the deviation of the oxidizing/reducing conditions at the catalytic converter from a desired oxidizing/reducing condition in a direction tending to restore the desired oxidizing/reducing condition, (c) applying fuel at the adjusted open loop determined fuel rate substantially continuously, (d) determining from at least one engine operating condition earlier in time by substantially the engine transport delay and the oxidizing/reducing conditions at the catalytic converter a change in the trimming value that more nearly provides the desired oxidizing/reducing conditions and (e) storing a new trimming value at the address of the earlier engine operating conditions that gave rise to the oxidizing/reducing conditions at the catalytic converter varying from the trimming value previously stored at said address in a sense tending to restore the desired oxidizing/reducing condition whereby the steps of adjusting the open loop determined fuel rate and storing a new trimming value cooperate to achieve the desired oxidizing/reducing conditions at the catalytic converter.

13. A fuel control system for an internal combustion engine having combustion space into which an air/fuel mixture is supplied to undergo combustion and having means defining an exhaust gas passage from the combustion space into which spent combustion gases are discharged and are directed to the atmosphere comprising, in combination:

a sensor responsive to the oxidizing/reducing conditions at a predetermined point in the exhaust passage, and hence, after a transport time delay period depending upon engine operating conditions, to the mixture supplied to the combustion space, the sensor having an output condition indicative of predetermined desired oxidizing/reducing conditions;

a memory having locations addressable in accordance with at least one engine operating parameter and having a number at each such location determinative of a fuel supply rate as determined by the engine operating parameter resulting in an air/fuel ratio to produce the predetermined desired oxidizing/reducing conditions;

means effective to supply fuel to the combustion space at a rate determined at least by the number recalled from the memory at the location of the current value of the predetermined engine operating parameter;

a fuel vapor trap effective to accumulate fuel vapors from fuel vapor sources during certain engine operating conditions and to discharge the accumulated fuel vapor into the combustion space during certain other engine operating conditions, the air/fuel ratio of the mixture provided to the combustion space when the fuel vapors are being discharged from the vapor trap having a value less than the air/fuel ratio determined by the number recalled from memory;

calibration learning means including sampling means effective to sample and store at recurrent intervals at least the predetermined engine operating parameter and means responsive to at least the engine operating parameter stored by the sampling means at the beginning of a particular transport time delay period and to the output condition of the sensor at the end of the particular transport time delay period effective to store in the memory at the address according to the engine operating parameter at the beginning of the particular transport time delay period a new number having a value differing from the value previously stored at such address in a sense tending to restore the sensor output to the desired output condition; and means responsive to said certain other engine operating conditions during which the accumulated fuel vapor in the fuel vapor trap is discharged into the combustion chamber effective to disable the calibration learning means to inhibit the storing of a new number in the memory so that the numbers in the address locations in the memory are unaffected by the oxidizing/reducing conditions existing in the exhaust gases resulting from discharge of the fuel vapors from the fuel vapor trap.

14. A fuel control system for an internal combustion engine having combustion space into which an air/fuel mixture is supplied to undergo combustion and having means defining an exhaust gas passage from the combustion space into which spent combustion gases are discharged and are directed to the atmosphere comprising, in combination:

a sensor responsive to the oxidizing/reducing conditions at a predetermined point in the exhaust passage and hence, after a transport time delay period dependent upon engine operating conditions, to the mixture supplied to the combustion space, the sensor having an output condition indicative of predetermined desired oxidizing/reducing conditions;

a memory having locations addressable in accordance with at least one engine operating condition and having a number at each such location determinative of a fuel supply rate as determined by the engine operating condition so as to produce the predetermined desired oxidizing/reducing condition;

means effective to recurrently sample at least the value of the engine operating condition at intervals substantially less than the smallest operating transport time delay;

a memory having sequential adress locations, the number of address locations being at least equal to the greatest operating transport time delay period divided by the sampling interval;

means effective to store the sampled values of the engine operating condition repetitively at sequential address locations in the memory to form a circulating memory that contains the most recent history of the sampled values at time related addresses;

means effective once during each of the intervals to determine the value of the transport time delay period from at least one engine operating parameter;

means effective during each of the intervals to recurrently recall the stored engine conditions at the address location spaced from the address location at which the most recent sampled engine conditions were stored by a number of sequential address locations equal to the determined transport delay period divided by the sampling interval; and means responsive to the recalled engine conditions and the condition of the sensor effective to store in the first memory at the location addressable in accordance with the recalled engine operating condition a new number having a value differing from the value previously stored at such address in a sense tending to restore the sensor output to the desired output condition.

* * * * *